US009407016B2

(12) United States Patent
Burris

(10) Patent No.: US 9,407,016 B2
(45) **Date of Patent: *Aug. 2, 2016**

(54) COAXIAL CABLE CONNECTOR WITH INTEGRAL CONTINUITY CONTACTING PORTION

(71) Applicant: Corning Optical Communications RF LLC, Glendale, AZ (US)

(72) Inventor: Donald Andrew Burris, Peoria, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 124 days.

This patent is subject to a terminal disclaimer.

(21) Appl. No.: 13/652,969

(22) Filed: Oct. 16, 2012

(65) Prior Publication Data

US 2014/0106612 A1 Apr. 17, 2014

Related U.S. Application Data

(60) Provisional application No. 61/601,821, filed on Feb. 22, 2012.

(51) Int. Cl.

| | |
|---|---|
| ***H01R 9/05*** | (2006.01) |
| ***H01R 4/30*** | (2006.01) |
| ***H01R 13/622*** | (2006.01) |

(52) U.S. Cl.

CPC ..... *H01R 4/304* (2013.01); *H01R 13/622* (2013.01); *H01R 9/0524* (2013.01); *Y10T 29/49123* (2015.01)

(58) Field of Classification Search

CPC ..... H01R 9/05; H01R 9/0524; H01R 9/0521; H01R 9/0518; H01R 9/0527; H01R 13/65802; H01R 9/0515; H01R 13/622

USPC ..... 439/578–585

See application file for complete search history.

(56) References Cited

U.S. PATENT DOCUMENTS

| | | | |
|---|---|---|---|
| 331,169 | A | 11/1885 | Thomas |
| 346,958 | A | 8/1886 | Stone |

(Continued)

FOREIGN PATENT DOCUMENTS

| | | |
|---|---|---|
| CA | 2096710 | 11/1994 |
| CN | 201149936 | 11/2008 |

(Continued)

OTHER PUBLICATIONS

Office Action dated Sep. 19, 2014 pertaining to U.S. Appl. No. 13/795,780.

(Continued)

*Primary Examiner* — Xuong Chung Trans

(74) *Attorney, Agent, or Firm* — Robert Low Branham

(57) ABSTRACT

A coaxial cable connector for coupling an end of a coaxial cable to a terminal is disclosed. The connector has a coupler adapted to couple the connector to a terminal, a body assembled with the coupler and a post assembled with the coupler and the body. The post is adapted to receive an end of a coaxial cable. The coupler, the body or the post has an integral, monolithic contacting portion. When the connector is coupled to the terminal and a coaxial cable is received by the body, the contacting portion provides for electrical continuity from an outer conductor of the coaxial cable through the connector to the terminal other than by a separate component. The contacting portion is formable and forms to a contour of at least one of the body and the coupler when the body at least partially assembles with the coupler.

28 Claims, 14 Drawing Sheets

(56) References Cited

U.S. PATENT DOCUMENTS

| | | | |
|---|---|---|---|
| 459,951 | A | 9/1891 | Warner |
| 589,216 | A | 8/1897 | McKee |
| 1,371,742 | A | 3/1921 | Dringman |
| 1,488,175 | A | 3/1924 | Strandell |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 1,959,302 | A | 5/1934 | Paige |
| 2,013,526 | A | 9/1935 | Schmitt |
| 2,059,920 | A | 11/1936 | Weatherhead, Jr. |
| 2,102,495 | A | 12/1937 | England |
| 2,258,528 | A | 10/1941 | Wurzburger |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,705,652 | A | 4/1955 | Kaiser |
| 2,743,505 | A | 5/1956 | Hill |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,785,384 | A | 3/1957 | Wickesser |
| 2,805,399 | A | 9/1957 | Leeper |
| 2,816,949 | A | 12/1957 | Curtiss |
| 2,870,420 | A | 1/1959 | Malek |
| 2,878,039 | A | 3/1959 | Hoegee et al. |
| 2,881,406 | A | 4/1959 | Arson |
| 2,963,536 | A | 12/1960 | Kokalas |
| 3,001,169 | A | 9/1961 | Blonder |
| 3,015,794 | A | 1/1962 | Kishbaugh |
| 3,051,925 | A | 8/1962 | Felts |
| 3,091,748 | A | 5/1963 | Takes et al. |
| 3,094,364 | A | 6/1963 | Lingg |
| 3,103,548 | A | 9/1963 | Concelman |
| 3,106,548 | A | 10/1963 | Lavalou |
| 3,140,106 | A | 7/1964 | Thomas et al. |
| 3,161,451 | A | 12/1964 | Neidecker |
| 3,184,706 | A | 5/1965 | Atkins |
| 3,193,309 | A | 7/1965 | Morris |
| 3,194,292 | A | 7/1965 | Borowsky |
| 3,196,382 | A | 7/1965 | Morello, Jr. |
| 3,206,540 | A | 9/1965 | Cohen |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,756 | A | 10/1966 | O'Keefe et al. |
| 3,281,757 | A | 10/1966 | Bonhomme |
| 3,290,069 | A | 12/1966 | Davis |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,667 | A | 10/1967 | Shreve |
| 3,350,677 | A | 10/1967 | Daum |
| 3,355,698 | A | 11/1967 | Keller |
| 3,372,364 | A | 3/1968 | O'Keefe et al. |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,499,671 | A | 3/1970 | Osborne |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,596,933 | A | 8/1971 | Luckenbill |
| 3,601,776 | A | 8/1971 | Curl |
| 3,603,912 | A | 9/1971 | Kelly |
| 3,614,711 | A | 10/1971 | Anderson et al. |
| 3,622,952 | A | 11/1971 | Hilbert |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,671,926 | A | 6/1972 | Nepovim |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,694,793 | A | 9/1972 | Concelman |
| 3,697,930 | A | 10/1972 | Shirey |
| 3,706,958 | A | 12/1972 | Blanchenot |
| 3,708,186 | A | 1/1973 | Takagi et al. |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,761,870 | A | 9/1973 | Drezin et al. |
| 3,778,535 | A | 12/1973 | Forney, Jr. |
| 3,781,762 | A | 12/1973 | Quackenbush |
| 3,781,898 | A | 12/1973 | Holloway |
| 3,783,178 | A | 1/1974 | Philibert et al. |
| 3,787,796 | A | 1/1974 | Barr |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,824,026 | A | 7/1974 | Gaskins |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,847,463 | A | 11/1974 | Hayward et al. |
| 3,854,003 | A | 12/1974 | Duret |
| 3,854,789 | A | 12/1974 | Kaplan |
| 3,858,156 | A | 12/1974 | Zarro |
| 3,879,102 | A | 4/1975 | Horak |
| 3,886,301 | A | 5/1975 | Cronin et al. |
| 3,907,335 | A | 9/1975 | Burge et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,937,547 | A | 2/1976 | Lee-Kemp |
| 3,953,097 | A | 4/1976 | Graham |
| 3,960,428 | A | 6/1976 | Naus et al. |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 3,986,736 | A | 10/1976 | Takagi et al. |
| 4,012,105 | A | 3/1977 | Biddle |
| 4,017,139 | A | 4/1977 | Nelson |
| 4,022,966 | A | 5/1977 | Gajajiva |
| 4,030,742 | A | 6/1977 | Eidelberg et al. |
| 4,030,798 | A | 6/1977 | Paoli |
| 4,032,177 | A | 6/1977 | Anderson |
| 4,045,706 | A | 8/1977 | Daffner et al. |

(56) References Cited

U.S. PATENT DOCUMENTS 4,046,451 A 9/1977 Juds et al.
4,053,200 A 10/1977 Pugner
4,056,043 A 11/1977 Sriramamurty et al.
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,100,943 A 7/1978 Terada et al.
4,106,839 A 8/1978 Cooper
4,109,126 A 8/1978 Halbeck
4,118,097 A 10/1978 Budnick
4,125,308 A 11/1978 Schilling
4,126,372 A 11/1978 Hashimoto et al.
4,131,332 A 12/1978 Hogendobler et al.
4,136,897 A 1/1979 Haluch
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,173,385 A 11/1979 Fenn et al.
4,174,875 A 11/1979 Wilson et al.
4,187,481 A 2/1980 Bourtos
4,193,655 A 3/1980 Herrmann, Jr.
4,194,338 A 3/1980 Trafton
4,197,628 A 4/1980 Conti et al.
4,206,963 A 6/1980 English et al.
4,212,487 A 7/1980 Jones et al.
4,225,162 A 9/1980 Dola
4,227,765 A 10/1980 Neumann et al.
4,229,714 A 10/1980 Yu
4,239,318 A 12/1980 Schwartz
4,250,348 A 2/1981 Kitagawa
4,260,212 A 4/1981 Ritchie
4,273,405 A 6/1981 Law
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,309,050 A 1/1982 Legris
4,310,211 A 1/1982 Bunnell et al.
4,322,121 A 3/1982 Riches et al.
4,326,768 A 4/1982 Punako
4,326,769 A 4/1982 Dorsey et al.
4,334,730 A 6/1982 Colwell et al.
4,339,166 A 7/1982 Dayton
4,345,375 A 8/1982 Hayward
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,428,639 A 1/1984 Hillis
4,444,453 A 4/1984 Kirby et al.
4,447,107 A 5/1984 Major et al.
4,452,503 A 6/1984 Forney, Jr.
4,456,323 A 6/1984 Pitcher et al.
4,459,881 A 7/1984 Hughes, Jr.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,477,132 A 10/1984 Moser et al.
4,484,792 A 11/1984 Tengler et al.
4,484,796 A 11/1984 Sato et al.
4,490,576 A 12/1984 Bolante et al.
4,491,685 A 1/1985 Drew et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,553,877 A 11/1985 Edvardsen
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,623,205 A 11/1986 Barron
4,632,487 A 12/1986 Wargula
4,634,213 A 1/1987 Larsson et al.
4,640,572 A 2/1987 Conlon
4,645,281 A 2/1987 Burger
4,647,135 A 3/1987 Reinhardt
4,650,228 A 3/1987 McMills et al.
4,655,159 A 4/1987 McMills
4,655,534 A 4/1987 Stursa
4,660,921 A 4/1987 Hauver
4,666,190 A 5/1987 Yamabe et al.
4,666,231 A 5/1987 Sheesley et al.
4,668,043 A 5/1987 Saba et al.
4,670,574 A 6/1987 Malcolm
4,673,236 A 6/1987 Musolff et al.
4,674,809 A 6/1987 Hollyday et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,713,021 A 12/1987 Kobler
4,717,355 A 1/1988 Mattis
4,720,155 A 1/1988 Schildkraut et al.
4,728,301 A 3/1988 Hemmer et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,126 A 4/1988 Gutter et al.
4,746,305 A 5/1988 Nomura
4,747,656 A 5/1988 Miyahara et al.
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman

(56) References Cited

U.S. PATENT DOCUMENTS 4,807,891 A 2/1989 Neher
4,808,128 A 2/1989 Werth
4,810,017 A 3/1989 Knak et al.
4,813,886 A 3/1989 Roos et al.
4,820,185 A 4/1989 Moulin
4,834,675 A 5/1989 Samchisen
4,834,676 A 5/1989 Tackett
4,835,342 A 5/1989 Guginsky
4,836,580 A 6/1989 Farrell
4,836,801 A 6/1989 Ramirez
4,838,813 A 6/1989 Pauza et al.
4,846,731 A 7/1989 Alwine
4,854,893 A 8/1989 Morris
4,857,014 A 8/1989 Alf et al.
4,867,489 A 9/1989 Patel
4,867,706 A 9/1989 Tang
4,869,679 A 9/1989 Szegda
4,874,331 A 10/1989 Iverson
4,881,912 A 11/1989 Thommen et al.
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,963,105 A 10/1990 Lewis et al.
4,964,805 A 10/1990 Gabany
4,964,812 A 10/1990 Siemon et al.
4,973,265 A 11/1990 Heeren
4,976,632 A 12/1990 Riches
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver, Jr. et al.
5,067,912 A 11/1991 Bickford et al.
5,073,129 A 12/1991 Szegda
5,074,809 A 12/1991 Rousseau et al.
5,080,600 A 1/1992 Baker et al.
5,083,943 A 1/1992 Tarrant
5,088,937 A 2/1992 Gabany
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,139,440 A 8/1992 Volk et al.
5,141,448 A 8/1992 Mattingly et al.
5,141,451 A 8/1992 Down
5,149,274 A 9/1992 Gallusser et al.
5,150,924 A 9/1992 Yokomatsu et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,176,530 A 1/1993 Reylek
5,176,533 A 1/1993 Sakurai et al.
5,181,161 A 1/1993 Hirose et al.
5,183,417 A 2/1993 Bools
5,186,501 A 2/1993 Mano
5,186,655 A 2/1993 Glenday et al.
5,195,904 A 3/1993 Cyvoct
5,195,905 A 3/1993 Pesci
5,195,906 A 3/1993 Szegda
5,205,547 A 4/1993 Mattingly
5,205,761 A 4/1993 Nilsson
D335,487 S 5/1993 Volk et al.
5,207,602 A 5/1993 McMills et al.
5,215,477 A 6/1993 Weber et al.
5,217,391 A 6/1993 Fisher, Jr.
5,217,392 A 6/1993 Hosler, Sr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,281,762 A 1/1994 Long et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al.
5,318,459 A 6/1994 Shields
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,352,134 A 10/1994 Jacobsen et al.
5,354,217 A 10/1994 Gabel et al.
5,362,250 A 11/1994 McMills et al.
5,362,251 A 11/1994 Bielak
5,366,260 A 11/1994 Wartluft
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,435,760 A 7/1995 Miklos
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda ..... 439/321
5,466,173 A 11/1995 Down
5,470,257 A 11/1995 Szegda
5,474,478 A 12/1995 Ballog
5,475,921 A 12/1995 Johnston
5,488,268 A 1/1996 Bauer et al.
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,511,305 A 4/1996 Garner
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda

(56) References Cited

U.S. PATENT DOCUMENTS 5,586,910 A 12/1996 Del Negro et al.
5,595,499 A 1/1997 Zander et al.
5,598,132 A 1/1997 Stabile
5,607,320 A 3/1997 Wright
5,607,325 A 3/1997 Toma
5,609,501 A 3/1997 McMills et al.
5,620,339 A 4/1997 Gray et al.
5,632,637 A 5/1997 Diener
5,632,651 A 5/1997 Szegda
5,644,104 A 7/1997 Porter et al.
5,649,723 A 7/1997 Larsson
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,743,131 A 4/1998 Holliday et al.
5,746,617 A 5/1998 Porter, Jr. et al.
5,746,619 A 5/1998 Harting et al.
5,759,618 A 6/1998 Taylor
5,769,652 A 6/1998 Wider
5,769,662 A 6/1998 Stabile et al.
5,774,344 A 6/1998 Casebolt
5,775,927 A 7/1998 Wider
5,788,289 A 8/1998 Cronley
5,791,698 A 8/1998 Wartluft et al.
5,797,633 A 8/1998 Katzer et al.
5,817,978 A 10/1998 Hermant et al.
5,863,220 A 1/1999 Holliday
5,874,603 A 2/1999 Arkles
5,877,452 A 3/1999 McConnell
5,879,191 A 3/1999 Burris
5,882,226 A 3/1999 Bell et al.
5,890,924 A 4/1999 Endo
5,897,795 A 4/1999 Lu et al.
5,906,511 A 5/1999 Bozzer et al.
5,917,153 A 6/1999 Geroldinger
5,921,793 A 7/1999 Phillips
5,938,465 A 8/1999 Fox, Sr.
5,944,548 A 8/1999 Saito
5,951,327 A 9/1999 Marik
5,954,708 A 9/1999 Lopez et al.
5,957,716 A 9/1999 Buckley et al.
5,967,852 A 10/1999 Follingstad et al.
5,975,479 A 11/1999 Suter
5,975,591 A 11/1999 Guest
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,036,540 A 3/2000 Beloritsky
6,042,422 A 3/2000 Youtsey
6,048,229 A 4/2000 Lazaro, Jr.
6,053,743 A 4/2000 Mitchell et al.
6,053,769 A 4/2000 Kubota et al.
6,053,777 A 4/2000 Boyle
6,062,607 A 5/2000 Bartholomew
6,080,015 A 6/2000 Andreescu
6,083,030 A 7/2000 Wright
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,093,043 A 7/2000 Gray et al.
6,095,828 A 8/2000 Burland
6,095,841 A 8/2000 Felps
6,123,550 A 9/2000 Burkert et al.
6,123,567 A 9/2000 McCarthy
6,126,487 A 10/2000 Rosenberger et al.
6,132,234 A 10/2000 Waidner et al.
6,142,812 A 11/2000 Hwang
6,146,197 A 11/2000 Holliday et al.
6,152,752 A 11/2000 Fukuda
6,152,753 A 11/2000 Johnson et al.
6,153,830 A 11/2000 Montena
6,162,995 A 12/2000 Bachle et al.
6,164,977 A 12/2000 Lester
6,174,206 B1 1/2001 Yentile et al.
6,183,298 B1 2/2001 Henningsen
6,199,913 B1 3/2001 Wang
6,199,920 B1 3/2001 Neustadtl
6,210,216 B1 4/2001 Tso-Chin et al.
6,210,219 B1 4/2001 Zhu et al.
6,210,222 B1 4/2001 Langham et al.
6,217,383 B1 4/2001 Holland et al.
6,238,240 B1 5/2001 Yu
6,239,359 B1 5/2001 Lilienthal, II et al.
6,241,553 B1 6/2001 Hsia
6,250,942 B1 6/2001 Lemke et al.
6,250,974 B1 6/2001 Kerek
6,257,923 B1 7/2001 Stone et al.
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,352,448 B1 3/2002 Holliday et al.
6,358,077 B1 3/2002 Young
6,361,348 B1 3/2002 Hall et al.
6,361,364 B1 3/2002 Holland et al.
6,375,509 B2 4/2002 Mountford
6,379,183 B1 4/2002 Ayres et al.
6,394,840 B1 5/2002 Gassauer et al.
6,396,367 B1 5/2002 Rosenberger
D458,904 S 6/2002 Montena
6,398,571 B1 6/2002 Nishide et al.
6,406,330 B2 6/2002 Bruce
6,409,534 B1 6/2002 Weisz-Margulescu
D460,739 S 7/2002 Fox
D460,740 S 7/2002 Montena
D460,946 S 7/2002 Montena
D460,947 S 7/2002 Montena
D460,948 S 7/2002 Montena
6,422,884 B1 7/2002 Babasick et al.
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,443,763 B1 9/2002 Richet
6,450,829 B1 9/2002 Weisz-Margulescu
6,454,463 B1 9/2002 Halbach
6,464,526 B1 10/2002 Seufert et al.
6,464,527 B2 10/2002 Volpe et al.
6,467,816 B1 10/2002 Huang
6,468,100 B1 10/2002 Meyer et al.
6,491,546 B1 12/2002 Perry
D468,696 S 1/2003 Montena
6,506,083 B1 1/2003 Bickford et al.
6,510,610 B2 1/2003 Losinger
6,520,800 B1 2/2003 Michelbach et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,637,101 B2 10/2003 Hathaway et al.
6,645,011 B2 11/2003 Schneider et al.
6,663,397 B1 12/2003 Lin et al.
6,676,446 B2 1/2004 Montena

(56) References Cited

U.S. PATENT DOCUMENTS 6,683,253 B1 1/2004 Lee
6,683,773 B2 1/2004 Montena
6,692,285 B2 2/2004 Islam
6,692,286 B1 2/2004 De Cet
6,695,636 B2 2/2004 Hall et al.
6,705,875 B2 3/2004 Berghorn et al.
6,705,884 B1 3/2004 McCarthy
6,709,280 B1 3/2004 Gretz
6,709,289 B2 3/2004 Huber et al.
6,712,631 B1 3/2004 Youtsey
6,716,041 B2 4/2004 Ferderer et al.
6,716,062 B1 4/2004 Palinkas et al. ..... 439/578
6,733,336 B1 5/2004 Montena et al.
6,733,337 B2 5/2004 Kodaira
6,743,040 B1 6/2004 Nakamura
6,749,454 B2 6/2004 Schmidt et al.
6,751,081 B1 6/2004 Kooiman
6,752,633 B2 6/2004 Aizawa et al.
6,761,571 B2 7/2004 Hida
6,767,248 B1 7/2004 Hung
6,769,926 B1 8/2004 Montena
6,780,029 B1 8/2004 Gretz
6,780,042 B1 8/2004 Badescu et al.
6,780,052 B2 8/2004 Montena et al.
6,780,068 B2 8/2004 Bartholoma et al.
6,783,394 B1 8/2004 Holliday
6,786,767 B1 9/2004 Fuks et al.
6,790,081 B2 9/2004 Burris et al.
6,793,528 B2 9/2004 Lin et al.
6,796,847 B2 9/2004 AbuGhazaleh
6,802,738 B1 10/2004 Henningsen
6,805,581 B2 10/2004 Love
6,805,583 B2 10/2004 Holliday et al.
6,805,584 B1 10/2004 Chen
6,808,415 B1 10/2004 Montena
6,817,272 B2 11/2004 Holland
6,817,896 B2 11/2004 Derenthal
6,817,897 B2 11/2004 Chee
6,827,608 B2 12/2004 Hall et al.
6,830,479 B2 12/2004 Holliday
6,848,115 B2 1/2005 Sugiura et al.
6,848,939 B2 2/2005 Stirling
6,848,940 B2 2/2005 Montena
6,848,941 B2 2/2005 Wlos et al.
6,884,113 B1 4/2005 Montena
6,884,115 B2 4/2005 Malloy
6,887,102 B1 5/2005 Burris et al.
6,916,200 B2 7/2005 Burris et al.
6,929,265 B2 8/2005 Holland et al.
6,929,508 B1 8/2005 Holland
6,935,866 B2 8/2005 Kerekes et al.
6,939,169 B2 9/2005 Islam et al.
6,942,516 B2 9/2005 Shimoyama et al.
6,942,520 B2 9/2005 Barlian et al.
6,945,805 B1 9/2005 Bollinger
6,948,976 B2 9/2005 Goodwin et al.
6,953,371 B2 10/2005 Baker et al.
6,955,563 B1 10/2005 Croan
D511,497 S 11/2005 Murphy et al.
D512,024 S 11/2005 Murphy et al.
D512,689 S 12/2005 Murphy et al.
6,971,912 B2 12/2005 Montena et al.
7,008,263 B2 3/2006 Holland
7,018,216 B1 3/2006 Clark et al.
7,018,235 B1 3/2006 Burris et al.
7,029,326 B2 4/2006 Montena
D521,454 S 5/2006 Murphy et al.
7,063,565 B2 6/2006 Ward
7,070,447 B1 7/2006 Montena
7,077,697 B2 7/2006 Kooiman
7,077,699 B2 7/2006 Islam et al.
7,086,897 B2 8/2006 Montena
7,090,525 B1 8/2006 Morana
7,094,114 B2 8/2006 Kurimoto
7,097,499 B1 8/2006 Purdy
7,102,868 B2 9/2006 Montena
7,108,547 B2 9/2006 Kisling et al.
7,108,548 B2 9/2006 Burris et al.
7,112,078 B2 9/2006 Czikora
7,112,093 B1 9/2006 Holland
7,114,990 B2 10/2006 Bence et al. ..... 439/583
7,118,285 B2 10/2006 Fenwick et al.
7,118,382 B2 10/2006 Kerekes et al.
7,118,416 B2 10/2006 Montena et al.
7,125,283 B1 10/2006 Lin
7,128,603 B2 10/2006 Burris et al.
7,128,604 B2 10/2006 Hall
7,131,867 B1 11/2006 Foster et al.
7,131,868 B2 11/2006 Montena
7,140,645 B2 11/2006 Cronley
7,144,271 B1 12/2006 Burris et al.
7,144,272 B1 12/2006 Burris et al.
7,147,509 B1 12/2006 Burris et al.
7,153,159 B2 12/2006 Burris et al.
7,156,696 B1 1/2007 Montena
7,161,785 B2 1/2007 Chawgo
7,165,974 B2 1/2007 Kooiman
7,173,121 B2 2/2007 Fang
7,179,121 B1 2/2007 Burris et al.
7,179,122 B2 2/2007 Holliday
7,182,639 B2 2/2007 Burris
7,183,639 B2 2/2007 Mihara et al.
7,189,097 B2 3/2007 Benham
7,189,114 B1 3/2007 Burris et al.
7,192,308 B2 3/2007 Rodrigues et al.
7,229,303 B2 6/2007 Vermoesen et al.
7,238,047 B2 7/2007 Saetele et al.
7,252,536 B2 8/2007 Lazaro, Jr. et al.
7,252,546 B1 8/2007 Holland
7,255,598 B2 8/2007 Montena et al.
7,261,594 B2 8/2007 Kodama et al.
7,264,502 B2 9/2007 Holland
7,278,882 B1 10/2007 Li
7,288,002 B2 10/2007 Rodrigues et al.
7,291,033 B2 11/2007 Hu
7,297,023 B2 11/2007 Chawgo
7,299,550 B2 11/2007 Montena
7,303,435 B2 12/2007 Burris et al.
7,311,555 B1 12/2007 Burris et al.
7,318,609 B2 1/2008 Naito et al.
7,322,846 B2 1/2008 Camelio
7,322,851 B2 1/2008 Brookmire
7,329,139 B2 2/2008 Benham
7,331,820 B2 2/2008 Burris et al.
7,335,058 B1 2/2008 Burris et al.
7,347,129 B1 3/2008 Youtsey
7,347,726 B2 3/2008 Wlos
7,347,727 B2 3/2008 Wlos et al.
7,347,729 B2 3/2008 Thomas et al.
7,351,088 B1 4/2008 Qu
7,357,641 B2 4/2008 Kerekes et al.
7,364,462 B2 4/2008 Holland
7,371,112 B2 5/2008 Burris et al.
7,371,113 B2 5/2008 Burris et al.
7,375,533 B2 5/2008 Gale
7,387,524 B2 6/2008 Cheng
7,393,245 B2 7/2008 Palinkas et al.
7,396,249 B2 7/2008 Kauffman
7,404,737 B1 7/2008 Youtsey
7,410,389 B2 8/2008 Holliday
7,416,415 B2 8/2008 Hart et al.
7,438,327 B2 10/2008 Auray et al.
7,452,239 B2 11/2008 Montena
7,455,550 B1 11/2008 Sykes
7,458,850 B1 12/2008 Burris et al.
7,458,851 B2 12/2008 Montena
7,462,068 B2 12/2008 Amidon
7,467,980 B2 12/2008 Chiu
7,476,127 B1 1/2009 Wei
7,478,475 B2 1/2009 Hall
7,479,033 B1 1/2009 Sykes et al.
7,479,035 B2 1/2009 Bence et al. ..... 439/583
7,484,988 B2 2/2009 Ma et al.
7,484,997 B2 2/2009 Hofling

(56) References Cited

U.S. PATENT DOCUMENTS 7,488,210 B1 2/2009 Burris et al.
7,494,355 B2 2/2009 Hughes et al.
7,497,729 B1 3/2009 Wei
7,500,868 B2 3/2009 Holland et al.
7,500,873 B1 3/2009 Hart
7,507,116 B2 3/2009 Laerke et al.
7,507,117 B2 3/2009 Amidon
7,513,788 B2 4/2009 Camelio
7,537,482 B2 5/2009 Burris et al.
7,540,759 B2 6/2009 Liu et al.
7,544,094 B1 6/2009 Paglia et al.
7,563,133 B2 7/2009 Stein
7,566,236 B2 7/2009 Malloy et al.
7,568,945 B2 8/2009 Chee et al.
7,578,693 B2 8/2009 Yoshida et al.
7,588,454 B2 9/2009 Nakata et al.
7,607,942 B1 10/2009 Van Swearingen
7,625,227 B1 12/2009 Henderson et al.
7,632,143 B1 12/2009 Islam
7,635,283 B1 12/2009 Islam
7,648,383 B2 1/2010 Matthias et al.
7,651,376 B2 1/2010 Schreier
7,674,132 B1 3/2010 Chen
7,682,177 B2 3/2010 Berthet
7,682,188 B1 3/2010 Lu
7,694,420 B2 4/2010 Ehret et al.
7,714,229 B2 5/2010 Burris et al.
7,726,996 B2 6/2010 Burris et al.
7,727,011 B2 6/2010 Montena et al.
7,749,021 B2 7/2010 Brodeur
7,753,705 B2 7/2010 Montena
7,753,710 B2 7/2010 George
7,753,727 B1 7/2010 Islam et al.
7,758,356 B2 7/2010 Burris et al.
7,758,370 B1 7/2010 Flaherty
7,794,275 B2 9/2010 Rodrigues
7,806,714 B2 10/2010 Williams et al.
7,806,725 B1 10/2010 Chen
7,811,133 B2 10/2010 Gray
7,814,654 B2 10/2010 Pichler
D626,920 S 11/2010 Purdy et al.
7,824,216 B2 11/2010 Purdy ..... 439/578
7,828,594 B2 11/2010 Burris et al.
7,828,595 B2 11/2010 Mathews
7,830,154 B2 11/2010 Gale
7,833,053 B2 11/2010 Mathews
7,845,976 B2 12/2010 Mathews
7,845,978 B1 12/2010 Chen
7,845,980 B1 12/2010 Amidon
7,850,472 B2 12/2010 Friedrich et al.
7,850,487 B1 12/2010 Wei
7,857,661 B1 12/2010 Islam
7,874,870 B1 1/2011 Chen
7,887,354 B2 2/2011 Holliday
7,892,004 B2 2/2011 Hertzler et al.
7,892,005 B2 2/2011 Haube ..... 439/321
7,892,024 B1 2/2011 Chen
7,914,326 B2 3/2011 Sutter
7,918,687 B2 4/2011 Paynter et al.
7,927,135 B1 4/2011 Wlos
7,934,955 B1 5/2011 Hsia
7,938,662 B2 5/2011 Burris et al.
7,942,695 B1 5/2011 Lu
7,950,958 B2 5/2011 Mathews
7,950,961 B2 5/2011 Chabalowski et al.
7,955,126 B2 6/2011 Bence et al.
7,972,158 B2 7/2011 Wild et al.
7,972,176 B2 7/2011 Burris et al.
7,982,005 B2 7/2011 Ames et al.
8,011,955 B1 9/2011 Lu
8,025,518 B2 9/2011 Burris et al.
8,029,315 B2 10/2011 Purdy et al.
8,029,316 B2 10/2011 Snyder et al.
8,037,599 B2 10/2011 Pichler
8,047,872 B2 11/2011 Burris et al.
8,062,044 B2 11/2011 Montena et al.
8,062,063 B2 11/2011 Malloy et al.
8,070,504 B2 12/2011 Amidon et al.
8,075,337 B2 12/2011 Malloy et al.
8,075,338 B1 * 12/2011 Montena ..... 439/578
8,079,860 B1 12/2011 Zraik
8,087,954 B2 1/2012 Fuchs
8,113,875 B2 2/2012 Malloy et al.
8,113,879 B1 2/2012 Zraik
8,157,587 B2 4/2012 Paynter et al.
8,157,588 B1 4/2012 Rodrigues et al.
8,167,635 B1 5/2012 Mathews
8,167,636 B1 5/2012 Montena
8,172,612 B2 5/2012 Bence et al.
8,177,572 B2 5/2012 Feye-Hohmann
8,192,237 B2 6/2012 Purdy et al.
8,206,172 B2 6/2012 Katagiri et al.
D662,893 S 7/2012 Haberek et al.
8,231,412 B2 7/2012 Paglia et al.
8,262,408 B1 9/2012 Kelly
8,272,893 B2 9/2012 Burris et al.
8,287,310 B2 10/2012 Burris et al.
8,287,320 B2 10/2012 Purdy et al.
8,313,345 B2 11/2012 Purdy
8,313,353 B2 11/2012 Purdy et al.
8,317,539 B2 11/2012 Stein
8,319,136 B2 11/2012 Byron et al.
8,323,053 B2 * 12/2012 Montena ..... 439/578
8,323,058 B2 12/2012 Flaherty et al.
8,323,060 B2 12/2012 Purdy et al.
8,337,229 B2 12/2012 Montena
8,366,481 B2 2/2013 Ehret et al.
8,366,482 B2 2/2013 Burris et al.
8,376,769 B2 2/2013 Holland et al.
D678,844 S 3/2013 Haberek
8,398,421 B2 3/2013 Haberek et al.
8,430,688 B2 4/2013 Montena et al.
8,449,326 B2 5/2013 Holland et al.
8,465,322 B2 6/2013 Purdy
8,469,739 B2 6/2013 Rodrigues et al.
8,469,740 B2 6/2013 Ehret et al.
D686,164 S 7/2013 Haberek et al.
D686,576 S 7/2013 Haberek et al.
8,475,205 B2 7/2013 Ehret et al.
8,480,430 B2 7/2013 Ehret et al.
8,480,431 B2 7/2013 Ehret et al.
8,485,845 B2 7/2013 Ehret et al.
8,506,325 B2 8/2013 Malloy et al.
8,517,763 B2 8/2013 Burris et al.
8,517,764 B2 8/2013 Wei et al.
8,529,279 B2 9/2013 Montena
8,550,835 B2 10/2013 Montena
8,568,163 B2 10/2013 Burris et al.
8,568,165 B2 10/2013 Wei et al.
8,591,244 B2 11/2013 Thomas et al.
8,597,050 B2 12/2013 Flaherty et al.
8,622,776 B2 1/2014 Morikawa
8,636,529 B2 1/2014 Stein
8,636,541 B2 1/2014 Chastain et al.
8,647,136 B2 2/2014 Purdy et al.
7,114,990 C1 4/2014 Bence et al.
8,690,603 B2 4/2014 Bence et al.
8,721,365 B2 5/2014 Holland
8,727,800 B2 5/2014 Holland et al.
8,758,050 B2 6/2014 Montena
8,777,658 B2 7/2014 Holland et al.
8,777,661 B2 7/2014 Holland et al.
8,172,612 C1 9/2014 Bence et al.
8,858,251 B2 10/2014 Montena
8,888,526 B2 11/2014 Burris
8,920,192 B2 12/2014 Montena
6,558,194 C1 1/2015 Montena
6,848,940 C1 1/2015 Montena
9,017,101 B2 4/2015 Ehret et al.
9,048,599 B2 6/2015 Burris
9,153,911 B2 10/2015 Burris et al.
9,166,348 B2 10/2015 Burris et al.
9,172,154 B2 10/2015 Burris
9,172,157 B2 10/2015 Burris

(56) References Cited

U.S. PATENT DOCUMENTS

2001/0034143 A1 10/2001 Annequin
2001/0046802 A1 11/2001 Perry et al.
2001/0051448 A1 12/2001 Gonzales
2002/0013088 A1 1/2002 Rodrigues et al.
2002/0019161 A1 2/2002 Finke et al.
2002/0038720 A1 4/2002 Kai et al.
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland
2004/0077215 A1 4/2004 Palinkas et al.
2004/0102089 A1 5/2004 Chee
2004/0137778 A1 7/2004 Mattheeuws et al.
2004/0157499 A1 8/2004 Nania et al.
2004/0194585 A1 10/2004 Clark
2004/0209516 A1 10/2004 Burris et al.
2004/0219833 A1 11/2004 Burris et al.
2004/0229504 A1 11/2004 Liu
2005/0042919 A1 2/2005 Montena
2005/0079762 A1 4/2005 Hsia
2005/0159045 A1 7/2005 Huang
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0233636 A1 10/2005 Rodrigues et al.
2006/0014425 A1 1/2006 Montena
2006/0099853 A1 5/2006 Sattele et al.
2006/0110977 A1 5/2006 Matthews
2006/0113107 A1 6/2006 Williams
2006/0154519 A1 7/2006 Montena
2006/0166552 A1 7/2006 Bence et al.
2006/0178034 A1 8/2006 Shimirak
2006/0178046 A1 8/2006 Tusini
2006/0194465 A1 8/2006 Czikora
2006/0199040 A1 9/2006 Yamada
2006/0223355 A1 10/2006 Hirschmann
2006/0246774 A1 11/2006 Buck
2006/0258209 A1 11/2006 Hall
2006/0276079 A1 12/2006 Chen
2007/0004276 A1 1/2007 Stein
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0123101 A1 5/2007 Palinkas
2007/0155232 A1 7/2007 Burris et al.
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0032556 A1 2/2008 Schreier
2008/0102696 A1 5/2008 Montena ..... 439/578
2008/0171466 A1 7/2008 Buck et al.
2008/0200066 A1 8/2008 Hofling
2008/0200068 A1 8/2008 Aguirre
2008/0214040 A1 9/2008 Holterhoff et al.
2008/0289470 A1 11/2008 Aston
2008/0310026 A1 12/2008 Nakayama
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1 5/2010 Montena
2010/0130060 A1 5/2010 Islam
2010/0178799 A1 7/2010 Lee
2010/0216339 A1 8/2010 Burris et al.
2010/0233901 A1 9/2010 Wild et al.
2010/0233902 A1 9/2010 Youtsey
2010/0233903 A1 9/2010 Islam
2010/0255719 A1 10/2010 Purdy ..... 439/578
2010/0255721 A1 10/2010 Purdy et al.
2010/0279548 A1 11/2010 Montena et al.
2010/0297871 A1 11/2010 Haube ..... 439/489
2010/0297875 A1 11/2010 Purdy et al. ..... 439/578
2010/0304579 A1 12/2010 Kisling
2010/0323541 A1 12/2010 Amidon et al.
2011/0021072 A1 1/2011 Purdy ..... 439/578
2011/0021075 A1 1/2011 Orner et al.
2011/0027039 A1 2/2011 Blair
2011/0039448 A1 2/2011 Stein
2011/0053413 A1 3/2011 Mathews
2011/0074388 A1 3/2011 Bowman
2011/0080158 A1 4/2011 Lawrence et al.
2011/0111623 A1 5/2011 Burris et al.
2011/0111626 A1 5/2011 Paglia et al.
2011/0117774 A1 5/2011 Malloy et al.
2011/0117776 A1 5/2011 Burris et al.
2011/0143567 A1 6/2011 Purdy et al. ..... 439/277
2011/0151714 A1 6/2011 Flaherty et al.
2011/0230089 A1 9/2011 Amidon et al. ..... 439/578
2011/0230091 A1 9/2011 Krenceski et al. ..... 439/578
2011/0237123 A1 9/2011 Burris et al.
2011/0237124 A1 9/2011 Flaherty et al.
2011/0250789 A1 10/2011 Burris et al.
2011/0318958 A1 12/2011 Burris et al.
2012/0021642 A1 1/2012 Zraik
2012/0040537 A1 2/2012 Burris
2012/0045933 A1 2/2012 Youtsey
2012/0064768 A1 3/2012 Islam et al.
2012/0094530 A1 4/2012 Montena
2012/0100751 A1 4/2012 Montena
2012/0108098 A1 5/2012 Burris et al.
2012/0122329 A1 5/2012 Montena
2012/0129387 A1 5/2012 Holland et al.
2012/0171894 A1 7/2012 Malloy et al.
2012/0178289 A1 7/2012 Holliday
2012/0202378 A1 8/2012 Krenceski et al.
2012/0222302 A1 9/2012 Purdy et al.
2012/0225581 A1 9/2012 Amidon et al.
2012/0315788 A1 12/2012 Montena
2013/0065433 A1 3/2013 Burris
2013/0072057 A1 3/2013 Burris
2013/0178096 A1 7/2013 Matzen
2013/0273761 A1 10/2013 Ehret et al.
2014/0106612 A1 4/2014 Burris
2014/0106613 A1 4/2014 Burris et al.
2014/0120766 A1 5/2014 Meister et al.
2014/0137393 A1 5/2014 Chastain et al.
2014/0148044 A1 5/2014 Balcer et al.
2014/0148051 A1 5/2014 Bence et al.
2014/0154907 A1 6/2014 Ehret et al.
2014/0298650 A1 10/2014 Chastain et al.
2014/0322968 A1 10/2014 Burris
2014/0342605 A1 11/2014 Burris et al.
2015/0118901 A1 4/2015 Burris
2015/0295331 A1 10/2015 Burris

FOREIGN PATENT DOCUMENTS

CN 201149937 11/2008
CN 201178228 1/2009
CN 201904508 7/2011
DE 47931 10/1888

(56) References Cited

FOREIGN PATENT DOCUMENTS

| | | |
|---|---|---|
| DE | 102289 | 7/1897 |
| DE | 1117687 | 11/1961 |
| DE | 2261973 | 6/1974 |
| DE | 3117320 | 4/1982 |
| DE | 3211008 | 10/1983 |
| DE | 9001608.4 | 4/1990 |
| DE | 4439852 | 5/1996 |
| DE | 19749130 | 8/1999 |
| DE | 19957518 | 9/2001 |
| DE | 10346914 | 5/2004 |
| EP | 115179 | 8/1984 |
| EP | 116157 | 8/1984 |
| EP | 167738 | 1/1986 |
| EP | 72104 | 2/1986 |
| EP | 223464 | 5/1987 |
| EP | 265276 | 4/1988 |
| EP | 350835 | 1/1990 |
| EP | 428424 | 5/1991 |
| EP | 867978 | 9/1998 |
| EP | 1069654 | 9/1998 |
| EP | 1094565 | 4/2001 |
| EP | 1115179 | 7/2001 |
| EP | 1191268 | 3/2002 |
| EP | 1455420 | 9/2004 |
| EP | 1501159 | 1/2005 |
| EP | 1548898 | 6/2005 |
| EP | 1603200 | 12/2005 |
| EP | 1701410 | 9/2006 |
| EP | 2051340 | 4/2009 |
| FR | 2204331 | 5/1974 |
| FR | 2232846 | 1/1975 |
| FR | 2462798 | 2/1981 |
| FR | 2494508 | 5/1982 |
| GB | 589697 | 6/1947 |
| GB | 1087228 | 10/1967 |
| GB | 1270846 | 4/1972 |
| GB | 1332888 | 10/1973 |
| GB | 1401373 | 7/1975 |
| GB | 1421215 | 1/1976 |
| GB | 2019665 | 10/1979 |
| GB | 2079549 | 1/1982 |
| GB | 2252677 | 8/1992 |
| GB | 2264201 | 8/1993 |
| GB | 2331634 | 5/1999 |
| GB | 2448595 | 10/2008 |
| GB | 2450248 | 12/2008 |
| JP | 3280369 | 12/1991 |
| JP | 200215823 | 1/2002 |
| JP | 4129978 | 8/2008 |
| JP | 2009277571 | 11/2009 |
| JP | 4391268 | 12/2009 |
| JP | 4503793 | 7/2010 |
| KR | 100622526 | 9/2006 |
| TW | 427044 | 3/2001 |
| WO | 8700351 | 1/1987 |
| WO | 00/05785 | 2/2000 |
| WO | 0186756 | 11/2001 |
| WO | 02069457 | 9/2002 |
| WO | 2004013883 | 2/2004 |
| WO | 2004098795 | 11/2004 |
| WO | 2006081141 | 8/2006 |
| WO | 2007062845 | 6/2007 |
| WO | 2009066705 | 5/2009 |
| WO | 2010135181 | 11/2010 |
| WO | 2011057033 | 5/2011 |
| WO | 2011128665 | 10/2011 |
| WO | 2011128666 | 10/2011 |
| WO | 2012162431 | 11/2012 |
| WO | 2013126629 | 8/2013 |

OTHER PUBLICATIONS

Office Action dated Oct. 6, 2014 pertaining to U.S. Appl. No. 13/732,679.

Office Action dated Jun. 12, 2014 pertaining to U.S. Appl. No. 13/795,737.

Office Action dated Aug. 25, 2014 pertaining to U.S. Appl. No. 13/605,481.

Office Action dated Aug. 29, 2014 pertaining to U.S. Appl. No. 13/827,522.

Election/Restrictions Requirement dated Jun. 20, 2014 pertaining to U.S. Appl. No. 13/795,780.

Office Action dated Mar. 19, 2015 pertaining to U.S. Appl. No. 13/795,780.

Notice of Allowance dated Feb. 2, 2015 pertaining to U.S. Appl. No. 13/795,737.

Office Action dated Feb. 25, 2015 pertaining to U.S. Appl. No. 13/605,481.

Office Action dated Feb. 18, 2015 pertaining to U.S. Appl. No. 13/827,522.

Office Action dated Dec. 29, 2014 pertaining to U.S. Appl. No. 13/833,793.

Office Action dated Dec. 16, 2014 pertaining to U.S. Appl. No. 13/653,095.

Office Action dated Dec. 31, 2014 pertaining to U.S. Appl. No. 13/605,498.

Patent Cooperation Treaty International Search Report, Application No. PCT/US2013/027222, Apr. 26, 2013, 2 pages.

Patent Cooperation Treaty, International Preliminary Report on Patentability for PCT/US2013/064512, mail date Apr. 30, 2015, 9 pages.

Patent Cooperation Treaty, International Preliminary Report on Patentability for PCT/US2013/064515, mail date Apr. 30, 2015, 8 pages.

Office Action dated Jun. 24, 2015 pertaining to U.S. Appl. No. 14/259,703.

Office Action dated Jul. 20, 2015 pertaining to U.S. Appl. No. 14/279,870.

Office Action dated Feb. 2, 2016 pertaining to U.S. Appl. No. 14/259,703.

Office Action dated Oct. 7, 2015 pertaining to U.S. Appl. No. 13/927,537.

Search Report dated Oct. 7, 2014 pertaining to International application No. PCT/US2014/043311.

Report on the Filing or Determination of an Action Regarding a Patent or Trademark regarding U.S. Pat. Nos. 8,313,353; 8,313,345; 8,323,060—Eastern District of Arkansas.

Report on the Filing or Determination of an Action Regarding a Patent or Trademark regarding U.S. Pat. Nos. 8,192,237; 8,287,320; 8,313,353; 8,323,060—Northern District of New York.

Report on the Filing or Determination of an Action Regarding a Patent or Trademark regarding U.S. Pat. No. 8,562,366—Northern District of New York.

Office Action dated Mar. 10, 2016 pertaining to U.S. Appl. No. 14/166,653.

Corning Gilbert 2004 OEM Coaxial Products Catalog, Quick Disconnects, 2 pages.

Digicon AVL Connector. ARRIS Group Inc. [online] 3 pages. Retrieved from the Internet: <URL: http://www.arrisi.com/special/digiconAVL.asp.

US Office Action, U.S. Appl. No. 10/997,218; Jul. 31, 2006, pp. 1-10.

Society of Cable Telecommunications Engineers, Engineering Committee, Interface Practices Subcommittee; American National Standard; ANSI/SCTE 01 2006; Specification for "F" Port, Female, Outdoor. Published Jan. 2006. 9 pages.

The American Society of Mechanical Engineers; "Lock Washers (Inch Series), An American National Standard"; ASME 818.21.1-1999 (Revision of ASME B18.21.1-1994); Reaffirmed 2005. Published Feb. 11, 2000. 28 pages.

U.S. Appl. No. 90/012,300, filed Jun. 29, 2012, regarding U.S. Pat. No. 8,172,612 filed May 27, 2011 (Bence et al.).

U.S. Appl. No. 90/012,749, filed Dec. 21, 2012, regarding U.S. Pat. No. 7,114,990, filed Jan. 25, 2005 (Bence et al.).

U.S. Appl. No. 90/012,835, filed Apr. 11, 2013, regarding U.S. Pat. No. 8,172,612 filed May 27, 2011 (Bence et al.).

Notice of Allowance (Mail Date Mar. 20, 2012) for U.S. Appl. No. 13/117,843.

Search Report dated Jun. 6, 2014 pertaining to International application No. PCT/US2014/023374.

(56) References Cited

OTHER PUBLICATIONS

Search Report dated Apr. 9, 2014 pertaining to International application No. PCT/US2014/015934.
Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.
PPC, "Next Generation Compression Connectors," pp. 1-6, Retrieved from http://www.tessco.com/yts/partnearnanufacturer list/vendors/ppc/pdf/ppc digital spread.pdf.
Patent Cooperation Treaty, International Search Report for PCT/US2013/070497, Feb. 11, 2014, 3 pgs.
Patent Cooperation Treaty, International Search Report for PCT/US2013/064515, 10 pgs.
Patent Cooperation Treaty, International Search Report for PCT/US2013/064512, Jan. 21, 2014, 11 pgs.
Huber+Suhner AG, RF Connector Guide: Understanding connector technology, 2007, Retrieved from http://www.ie.itcr.ac.cr/marin/lic/e14515/HUBER+SUENER_RF_Connector_Guide.pdf.
Slade, Paul G,. Electrical Contacts: Principles and Applications, 1999, Retrieved from http://books.google.com/books (table of contents only).
U.S. Appl. No. 95/002,400, filed Sep. 15, 2012, regarding U.S. Pat. No. 8,192,237 filed Feb. 23, 2011 (Purdy et al.).
U.S. Appl. No. 90/013,068, filed Nov. 27, 2013, regarding U.S. Pat. No. 6,558,194 filed Jul. 21, 2000 (Montena).
U.S. Appl. No. 90/013,069, filed Nov. 27, 2013, regarding U.S. Pat. No. 6,848,940 filed Jan. 21, 2003 (Montena).
U.S. Inter Partes Review Case No. 2013-00346 filed Jun. 10, 2013, regarding U.S. Pat. No. 8,287,320 filed Dec. 8, 2009, claims 1-8, 10-16, 18-31 (Purdy et al.).
U.S. Inter Partes Review Case No. 2013-00343 filed Jun. 10, 2013, regarding U.S. Pat. No. 8,313,353 filed Apr. 30, 2012, claims 1-6 (Purdy et al.).
U.S. Inter Partes Review Case No. 2013-00340 filed Jun. 10, 2013, regarding U.S. Pat. No. 8,323,060 filed Jun. 14, claims 1-9 (Purdy et al.).
U.S. Inter Partes Review Case No. 2013-00347 filed Jun. 10, 2013, regarding U.S. Pat. No. 8,287,320 filed Dec. 8, 2009, claims 9, 17, 32 (Purdy et al.).
U.S. Inter Partes Review Case No. 2013-00345 filed Jun. 10, 2013, regarding U.S. Pat. No. 8,313,353 filed Apr. 30, 2012, claims 7-27 (Purdy et al.).
U.S. Inter Partes Review Case No. 2013-00342 filed Jun. 10, 2013, regarding U.S. Pat. No. 8,323,060 filed Jun. 14, 2012, claims 10-25 (Purdy et al.).
U.S. Inter Partes Review Case No. 2014-00441 filed Feb. 18, 2014, regarding U.S. Pat. No. 8,562,366 filed Oct. 15, 2012, claims 31,37, 39, 41, 42, 55 56 (Purdy et al.).
U.S. Inter Partes Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).
Corning Cabelcon waterproof CX3 7.0 QuickMount for RG6 cables; Cabelcon Connectors; www.cabelcom.dk; Mar. 15, 2012.
Maury Jr., M.; Microwave Coaxial Connector Technology: A Continuaing Evolution; Maury Microwave Corporation; Dec. 13, 2005; pp. 1-21; Maury Microwave Inc.
"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; p. 26.
UltraEase Compression Connectors; "F" Series 59 and 6 Connectors Product Information; May 2005; 4 pgs.
Pomona Electronics Full Line Catelog; vol. 50; 2003; pp. 1-100.

* cited by examiner

COAXIAL CABLE CONNECTOR WITH INTEGRAL CONTINUITY CONTACTING PORTION

RELATED APPLICATIONS

This application claims the benefit of priority under 35 U.S.C. §119 of U.S. Provisional Application Ser. No. 61/601,821 filed on Feb. 22, 2012 the content of which is relied upon and incorporated herein by reference in its entirety.

This application is related to U.S. application Ser. No. 13/198,765, filed Aug. 5, 2011, entitled "Coaxial Cable Connector with Radio Frequency Interference and Grounding Shield", which is incorporated herein by reference in its entirety.

This application is related to U.S. application Ser. No. 13/653,095, filed Oct. 16, 2012, entitled "Coaxial Cable Connector with Integral RFI Protection," which is incorporated herein by reference in its entirety.

BACKGROUND

1. Field of the Disclosure

The disclosure relates generally to coaxial cable connectors, and particularly to a coaxial cable connector having an integral contacting portion that is monolithic with another coaxial cable connector component and provides for continuity between a coaxial cable and an appliance equipment connection port for radio frequency interference (RFI) and grounding shielding other than by a separate continuity member, regardless of the tightness of the coupling of the coaxial cable connector to the appliance equipment connection port, and without restricting the movement of the coupler of the coaxial cable connector when being attached to the appliance equipment connection.

2. Technical Background

Coaxial cable connectors, such as type F connectors, are used to attach coaxial cable to another object or appliance, e.g., a television set, DVD player, modem or other electronic communication device having a terminal adapted to engage the connector. The terminal of the appliance includes an inner conductor and a surrounding outer conductor.

Coaxial cable includes a center conductor for transmitting a signal. The center conductor is surrounded by a dielectric material, and the dielectric material is surrounded by an outer conductor. The outer conductor may be in the form of a conductive foil and/or braided sheath. The outer conductor is typically maintained at ground potential to shield the signal transmitted by the center conductor from stray noise, and to maintain a continuous, desired impedance over the signal path. The outer conductor is usually surrounded by a plastic cable jacket that electrically insulates, and mechanically protects, the outer conductor. Prior to installing a coaxial connector onto an end of the coaxial cable, the end of the coaxial cable is typically prepared by stripping off the end portion of the jacket to expose the end portion of the outer conductor. Similarly, it is common to strip off a portion of the dielectric to expose the end portion of the center conductor.

Coaxial cable connectors of the type known in the trade as "F connectors" often include a tubular post designed to slide over the dielectric material, and under the outer conductor of the coaxial cable, at the prepared end of the coaxial cable. If the outer conductor of the cable includes a braided sheath, then the exposed braided sheath is usually folded back over the cable jacket. The cable jacket and folded-back outer conductor extend generally around the outside of the tubular post and are typically received in an outer body of the connector.

The outer body of the connector is often fixedly secured to the tubular post. A coupler is typically rotatably secured around the tubular post and includes an internally-threaded region for engaging external threads formed on the outer conductor of the appliance terminal. Alternatively or additionally, the coupler may friction fit, screw and/or latch on to the outer conductor of the appliance terminal.

When connecting the end of a coaxial cable to a terminal of a television set, equipment box, modem, computer or other appliance, it is important to achieve a reliable electrical connection between the outer conductor of the coaxial cable and the outer conductor of the appliance terminal. Typically, this goal is usually achieved by ensuring that the coupler of the connector is fully tightened over the connection port of the appliance. When fully tightened, the head of the tubular post of the connector directly engages the edge of the outer conductor of the appliance port, thereby making a direct electrical ground connection between the outer conductor of the appliance port and the tubular post. The tubular post is engaged with the outer conductor of the coaxial cable.

The increased use of self-install kits provided to home owners by some CATV system operators has resulted in customer complaints due to poor picture quality in video systems and/or poor data performance in computer/internet systems. Additionally, CATV system operators have found upstream data problems induced by entrance of unwanted RF signals into their systems. Complaints of this nature result in CATV system operators having to send a technician to address the issue. Frequently, it is reported by the technician that the cause of the problem is due to a loose F connector fitting, sometimes as a result of inadequate installation of the self-install kit by the homeowner. An improperly installed or loose connector may result in poor signal transfer because there are discontinuities along the electrical path between the devices, resulting in ingress of undesired radio frequency ("RF") signals where RF energy from an external source or sources may enter the connector/cable arrangement causing a signal to noise ratio problem resulting in an unacceptable picture or data performance. Many of the current state of the art F connectors rely on intimate contact between the F male connector interface and the F female connector interface. If, for some reason, the connector interfaces are allowed to pull apart from each other, such as in the case of a loose F male coupler, an interface "gap" may result. If not otherwise protected this gap can be a point of RF ingress as previously described.

As mentioned above, the coupler is typically rotatably secured about the head of the tubular post. The head of the tubular post usually includes an enlarged shoulder, and the coupler typically includes an inwardly-directed flange for extending over and around the shoulder of the tubular post. In order not to interfere with free rotation of the coupler, manufacturers of such F-style connectors routinely make the outer diameter of the shoulder (at the head of the tubular post) of smaller dimension than the inner diameter of the central bore of the coupler. Likewise, manufacturers routinely make the inner diameter of the inwardly-directed flange of the coupler of larger dimension than the outer diameter of the non-shoulder portion of the tubular post, again to avoid interference with rotation of the coupler relative to the tubular post. In a loose connection system, wherein the coupler of the coaxial connector is not drawn tightly to the appliance port connector, an alternate ground path may fortuitously result from contact between the coupler and the tubular post, particularly if the coupler is not centered over, and axially aligned with, the tubular post. However, this alternate ground path is not stable, and can be disrupted as a result of vibrations, movement of the appliance, movement of the cable, or the like.

Alternatively, there are some cases in which such an alternate ground path is provided by fortuitous contact between the coupler and the outer body of the coaxial connector, provided that the outer body is formed from conductive material. This alternate ground path is similarly unstable, and may be interrupted by relative movement between the appliance and the cable, or by vibrations. Moreover, this alternate ground path does not exist at all if the outer body of the coaxial connector is constructed of non-conductive material. Such unstable ground paths can give rise to intermittent failures that are costly and time-consuming to diagnose.

Coaxial cable connectors have attempted to address the above problems by incorporating a continuity member into the coaxial cable connector as a separate component. In this regard, FIG. 1 illustrates a connector 1000 in the prior art having a coupler 2000, a separate post 3000, a separate continuity member 4000, and a body 5000. In connector 1000 the separate continuity member 4000 is captured between post 3000 and body 5000 and contacts at least a portion of coupler 2000. Coupler 2000 is preferably made of metal such as brass and plated with a conductive material such as nickel. Post 3000 is preferably made of metal such as brass and plated with a conductive material such as tin. Separate conductive member 4000 is preferably made of metal such as phosphor bronze and plated with a conductive material such as tin. Body 5000 is preferably made of metal such as brass and plated with a conductive material such as nickel.

SUMMARY OF THE DETAILED DESCRIPTION

Embodiments disclosed herein include a coaxial cable connector for coupling an end of a coaxial cable to a terminal. The connector has a coupler adapted to couple the connector to a terminal, a body assembled with the coupler and a post assembled with the coupler and the body. The post is adapted to receive an end of a coaxial cable. The coupler, the body or the post has an integral contacting portion. The contacting portion is monolithic with at least a portion of at least one of the coupler, the body, and the post. When the connector is coupled to the terminal and a coaxial cable is received by the body, the contacting portion provides for electrical continuity from an outer conductor of the coaxial cable through the connector to the terminal regardless of the tightness of the coupling of the connector to the terminal. Electrical continuity means a DC contact resistance from the outer conductor of the coaxial cable to the equipment port through the connector of less than about 3000 milliohms. Additionally, electrical continuity from an outer conductor of the coaxial cable through the connector to the terminal may be provided other than by a separate continuity component. The contacting portion is constructed of a material having an elastic/plastic property allowing it to maintain electrical and mechanical contact notwithstanding any interstice between components of the connector when assembled. The contacting portion is formable and forms to a contour of at least one of the body and the coupler when the body at least partially assembles with the coupler. The contacting portion may form to at least a partially arcuate shape.

In yet another aspect, embodiments disclosed herein include a coaxial cable connector having a coupler having a central bore and adapted to couple the connector to a terminal, a body having a central passage assembled with the coupler, and a post assembled with the coupler and the body. The post is disposed at least partially within the central passage of the body and at least partially within the central bore of the coupler. The body and the post are adapted to receive an end of a coaxial cable. The post has a contacting portion that provides for uninterrupted electrical continuity from an outer conductor of the coaxial cable received by the body and the post through the connector to the terminal coupled by the coupler regardless of the tightness of the coupling of the connector to the terminal. Electrical continuity means a DC contact resistance from the outer conductor of the coaxial cable to the equipment port through the connector of less than about 3000 milliohms. The contacting portion is constructed from a single piece of material with a portion of the post. The contacting portion is constructed of a material having an elastic/plastic property allowing it to maintain electrical and mechanical contact notwithstanding any interstice between components of the connector when assembled. The contacting portion is formable and forms to a contour of at least one of the body and the coupler when the post at least partially assembles with one of the body and the coupler. The contacting portion may form to at least a partially arcuate shape. The contacting portion may be a protrusion and may be radially projecting. Additionally or alternatively, the contacting portion may have a multi-cornered configuration. The contacting portion may form in response to a forming tool. The contacting portion may be segmented In yet another aspect, embodiments disclosed herein include a method of providing uninterrupted continuity in a coaxial cable connector. The method includes providing components of a coaxial cable connector. At least one of the components has a formable continuity portion which is monolithic with the at least one of the components. The method also includes assembling the components to provide a coaxial cable connector. The assembling forms the electrical continuity portion to a contour of one of the other components. The components may be comprised from the group consisting of a coupler, a body, and a post. Electrical continuity means a DC contact resistance from the outer conductor of the coaxial cable to the equipment port through the connector of less than about 3000 milliohms. The method further includes receiving by one of the components a coaxial cable, and coupling by one of the components the coaxial cable connector to a terminal. The contacting portion provides for continuity from an outer conductor of the coaxial cable through the connector to the terminal other than by a separate component, and is regardless of the tightness of the coupling of the connector to the terminal. The contacting portion is constructed of a material having an elastic/plastic property allowing it to maintain electrical and mechanical contact notwithstanding any interstice between components when assembled.

In yet another aspect, embodiments disclosed herein include a coaxial cable connector for coupling an end of a coaxial cable to a terminal. The connector has a coupler adapted to couple the connector to a terminal and a body assembled with the coupler and adapted to receive an end of a coaxial cable. The coupler or the body has an integral contacting portion. The contacting portion is constructed from, and wherein the contacting portion is monolithic with at least a portion of at least one of the coupler and the body or a portion thereof. When the connector is coupled to the terminal and a coaxial cable is received by the body, the contacting portion provides for continuity from an outer conductor of the coaxial cable through the connector to the terminal other than by a separate component and regardless of the tightness of the coupling of the connector to the terminal. Electrical continuity means a DC contact resistance from the outer conductor of the coaxial cable to the equipment port through the connector of less than about 3000 milliohms. The contacting portion is constructed of a material having an elastic/plastic property allowing it to maintain electrical and mechanical contact notwithstanding any interstice between components of the connector when assembled. The contacting portion is formable and forms to a contour of at least one of the body and the coupler when the body at least partially assembles with the coupler. The contacting portion may form to at least a partially arcuate shape.

Additional features and advantages are set out in the detailed description which follows, and in part will be readily apparent to those skilled in the art from that description or recognized by practicing the embodiments as described herein, including the detailed description, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1:
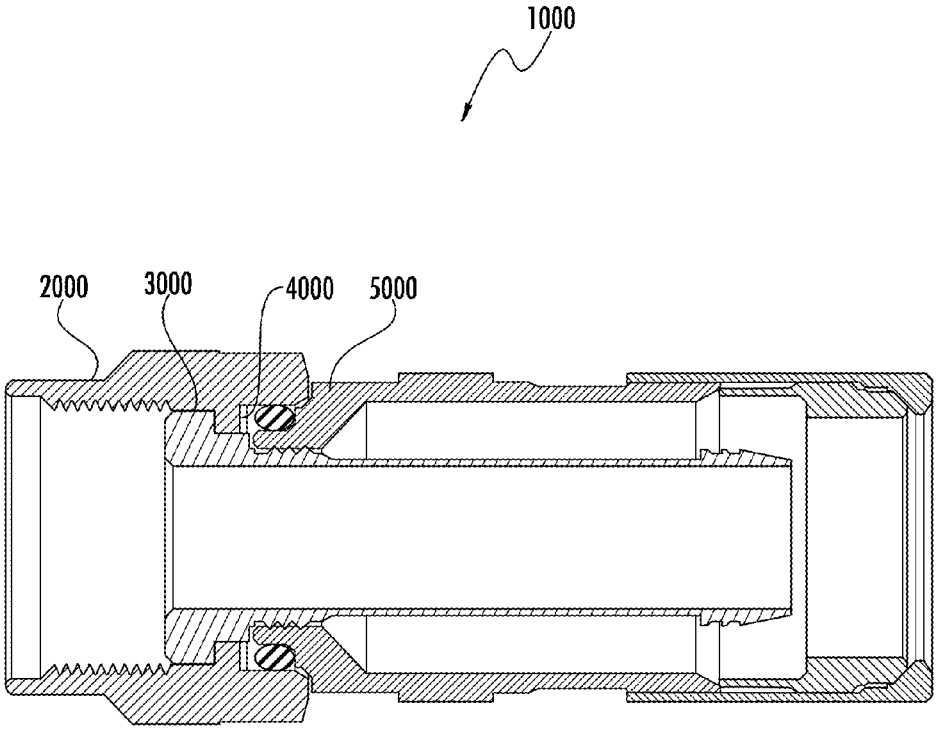
FIG. 1 (PRIOR ART)
FIG. 1 is a side cross sectional view of a coaxial cable connector in the prior art.

Reference will now be made in detail to the embodiments, examples of which are illustrated in the accompanying drawings, in which some, but not all embodiments are shown. Indeed, the concepts may be embodied in many different forms and should not be construed as limiting herein. Rather, these embodiments are provided so that this disclosure will satisfy applicable legal requirements. Whenever possible, like reference numbers will be used to refer to like components or parts.

Coaxial cable connectors are used to couple a prepared end of a coaxial cable to a threaded female equipment connection port of an appliance. The coaxial cable connector may have a post, a moveable post or be postless. In each case though, in addition to providing an electrical and mechanical connection between the conductor of the coaxial connector and the conductor of the female equipment connection port, the coaxial cable connector provides a ground path from an outer conductor of the coaxial cable to the equipment connection port. The outer conductor may be, as examples, a conductive foil or a braided sheath. Maintaining a stable ground path protects against the ingress of undesired radio frequency ("RF") signals which may degrade performance of the appliance. This is especially applicable when the coaxial cable connector is not fully tightened to the equipment connection port, either due to not being tightened upon initial installation or due to becoming loose after installation.

For purposes of this description, the term "forward" will be used to refer to a direction toward the portion of the coaxial cable connector that attaches to a terminal, such as an appliance equipment port. The term "rearward" will be used to refer to a direction that is toward the portion of the coaxial cable connector that receives the coaxial cable. The term "terminal" will be used to refer to any type of connection medium to which the coaxial cable connector may be coupled, as examples, an appliance equipment port, any other type of connection port, or an intermediate termination device. Additionally, for purposes herein, electrical continuity shall mean DC contact resistance from the outer conductor of the coaxial cable to the equipment port of less than about 3000 milliohms. Accordingly, a DC contact resistance of more than about 3000 milliohms shall be considered as indicating electrical discontinuity or an open in the path between the outer conductor of the coaxial cable and the equipment port.

Embodiments relate to a coaxial cable connector for coupling an end of a coaxial cable to a terminal. The connector has a coupler adapted to couple the connector to a terminal and a body assembled with the coupler and adapted to receive an end of a coaxial cable. The coaxial cable connector may also have a post. A contacting portion may be integral to one or more of the coupler, the body and/or the post. Moreover, the contacting portion may be integral with a component, that as non-limiting examples, may be one or more of the coupler, the body or the post, either individually or in combination. Additionally, the contacting portion may be of monolithic construction, being formed or constructed in a unitary fashion from a single piece of material, with that component or a portion of that component. In other words, and as a non-limiting example, if the contacting portion is of monolithic construction with the post, the contacting portion may be constructed from a single piece of material with the post or a portion of the post. Additionally, the contacting portion may have or be any shape, including shapes that may be flush or aligned with other portions of the coupler, the body, the post, or another component of the coaxial cable connector, or may protrude from the coupler, the body, the post, or another component of the coaxial cable connector.

Any portion of the coupler, body or post may be formed from any electrically conductive material, either a metal or a non-metal, provided that electrical continuity is maintained from the outer conductor of the coaxial cable through the connector to the equipment port. Further, a non-conductive material, as a non-limiting example, a polymer, with an electrically conductive coating or plating on a portion thereof may be used. Moreover, the body may be completely non-conductive, and electrical continuity from the outer conductor of the coaxial cable through the connector to the equipment port may be maintained through one or more of the other components of the coaxial cable connector.

The contacting portion may have any number of configurations, as non-limiting examples, partially or completely circular, single-cornered, or multi-cornered. When the coaxial cable connector is assembled, coupled to the terminal and a coaxial cable is received by the body, the contacting portion provides for electrical continuity from an outer conductor of the coaxial cable through the connector to the terminal other than by a separate component and regardless of the tightness or adequacy of the coupling of the connector to the terminal. The contacting portion may, but does not have to be at least partially radially projecting. The contacting portion may be formable and form to a contour of at least one of the body and the coupler. The contacting portion may form to at least a partially arcuate shape. Additionally and/or alternatively, the contacting portion may form in response to a forming tool. Further, a lubricant or grease, in particular a conductive lubricant or grease, may be applied to the contacting portion.

Embodiments also relate to a method of providing uninterrupted electrical continuity in a coaxial cable connector. The method includes providing components of a coaxial cable connector. At least one of the components has a formable electrical continuity portion. The method also includes assembling the components to provide a coaxial cable connector. The assembling forms the electrical continuity portion to a contour of one of the other components. The components may be comprised from the group consisting of a coupler, a body, and a post. The method further includes receiving by one of the components a coaxial cable, and coupling by one of the components the coaxial cable connector to a terminal. The contacting portion provides for electrical continuity from an outer conductor of the coaxial cable through the connector to the terminal other than by a separate component, and is regardless of the tightness or adequacy of the coupling of the connector to the terminal.

Figure 2:
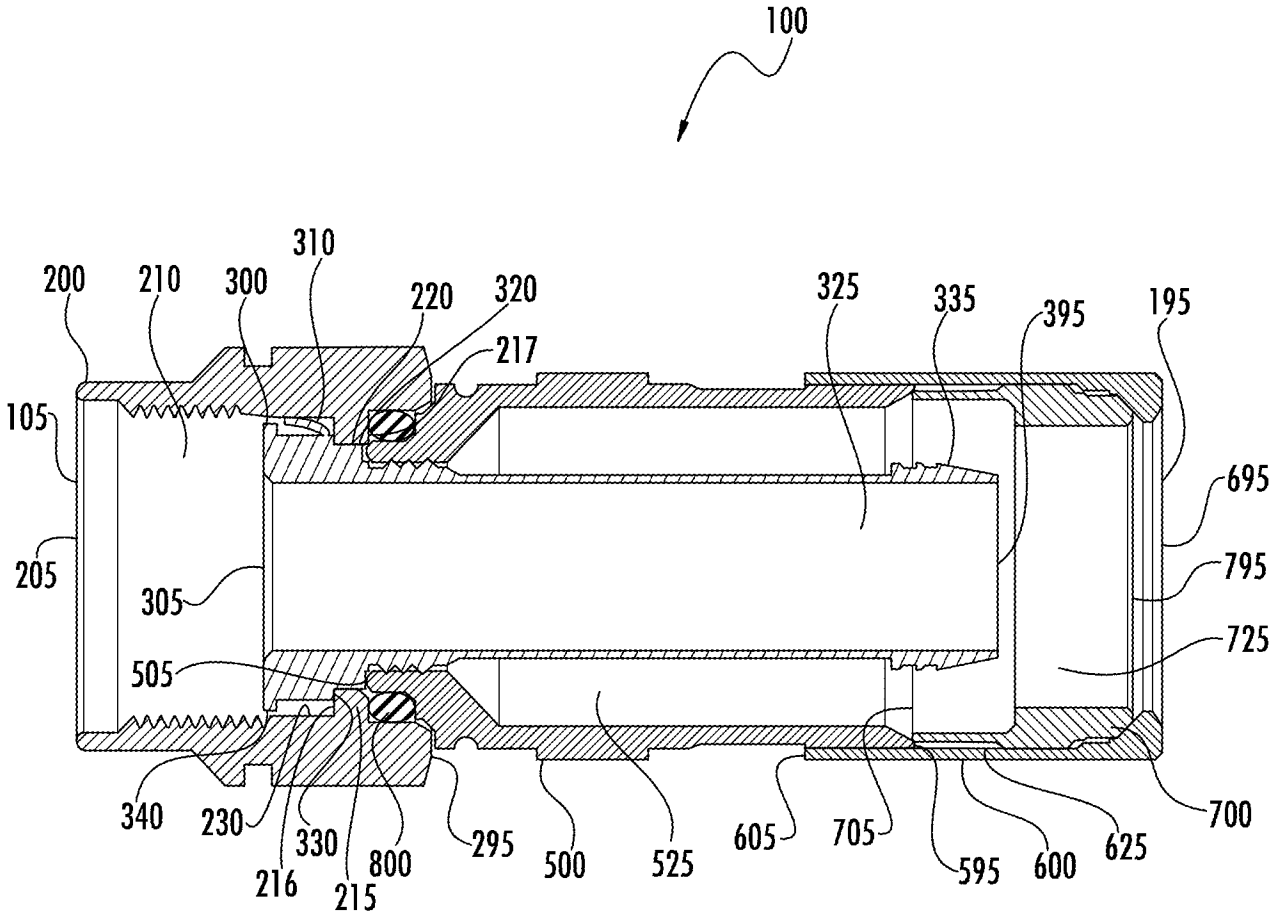
FIG. 2 is a side, cross sectional view of an exemplary embodiment of a coaxial connector comprising a post with a contacting portion providing an integral RFI and grounding shield.

Referring now to FIG. 2, there is illustrated an exemplary embodiment of a coaxial cable connector 100. The coaxial cable connector 100 has a front end 105, a back end 195, a coupler 200, a post 300, a body 500, a shell 600 and a gripping member 700. The coupler 200 at least partially comprises a front end 205, a back end 295, a central passage 210, a lip 215 with a forward facing surface 216 and a rearward facing surface 217, a through-bore 220 formed by the lip 215, and a bore 230. Coupler 200 is preferably made of metal such as brass and plated with a conductive material such as nickel. Alternately or additionally, selected surfaces of the coupler 200 may be coated with conductive or non-conductive coatings or lubricants, or a combinations thereof. Post 300, may be tubular, at least partially comprises a front end 305, a back end 395, and a contacting portion 310. In FIG. 2, Contacting portion 310 is shown as a protrusion integrally formed and monolithic with post 300. Contacting portion 310 may, but does not have to be, radially projecting. Post 300 may also comprise an enlarged shoulder 340, a collar portion 320, a through-bore 325, a rearward facing annular surface 330, and a barbed portion 335 proximate the back end 395. The post 300 is preferably made of metal such as brass and plated with a conductive material such as tin. Additionally, the material, in an exemplary embodiment, may have a suitable spring characteristic permitting contacting portion 310 to be flexible, as described below. Alternately or additionally, selected surfaces of post 300 may be coated with conductive or non-conductive coatings or lubricants or a combination thereof. Contacting portion 310, as noted above, is monolithic with post 300 and provides for electrical continuity through the connector 100 to an equipment port (not shown in FIG. 2) to which connector 100 may be coupled. In this manner, post 300 provides for a stable ground path through the connector 100, and, thereby, electromagnetic shielding to protect against the ingress and egress of RF signals. Body 500 at least partially comprises a front end 505, a back end 595, and a central passage 525. Body 500 is preferably made of metal such as brass and plated with a conductive material such as nickel. Shell 600 at least partially comprises a front end 605, a back end 695, and a central passage 625. Shell 600 is preferably made of metal such as brass and plated with a conductive material such as nickel. Gripping member 700 at least partially comprises a front end 705, a back end 795, and a central passage 725. Gripping member 700 is preferably made of a suitable polymer material such as acetal or nylon. The resin can be selected from thermoplastics characterized by good fatigue life, low moisture sensitivity, high resistance to solvents and chemicals, and good electrical properties.

In FIG. 2, coaxial cable connector 100 is shown in an unattached, uncompressed state, without a coaxial cable inserted therein. Coaxial cable connector 100 couples a prepared end of a coaxial cable to a terminal, such as a threaded female equipment appliance connection port (not shown in FIG. 2). This will be discussed in more detail with reference to FIG. 18A. Shell 600 slideably attaches to body 500 at back end 595 of body 500. Coupler 200 attaches to coaxial cable connector 100 at back end 295 of coupler 200. Coupler 200 may rotatably attach to front end 305 of post 300 while engaging body 500 by means of a press-fit. Front end 305 of post 300 positions in central passage 210 of coupler 200 and has a back end 395 which is adapted to extend into a coaxial cable. Proximate back end 395, post 300 has a barbed portion 335 extending radially outwardly from post 300. An enlarged shoulder 340 at front end 305 extends inside the coupler 200. Enlarged shoulder 340 comprises a collar portion 320 and a rearward facing annular surface 330. Collar portion 320 allows coupler 200 to rotate by means of a clearance fit with through-bore 220 of coupler 200. Rearward facing annular surface 330 limits forward axial movement of the coupler 200 by engaging forward facing surface 216 of lip 215. Coaxial cable connector 100 may also include a sealing ring 800 seated within coupler 200 to form a seal between coupler 200 and body 500.

Contacting portion 310 may be monolithic with or a unitized portion of post 300. As such, contacting portion 310 and post 300 or a portion of post 300 may be constructed from a single piece of material. The contacting portion 310 may contact coupler 200 at a position that is forward of forward facing surface 216 of lip 215. In this way, contacting portion 310 of post 300 provides an electrically conductive path between post 300, coupler 200 and body 500. This enables an electrically conductive path from coaxial cable through coaxial cable connector 100 to terminal providing an electrical ground and a shield against RF ingress and egress. Contacting portion 310 is formable such that as the coaxial cable connector 100 is assembled, contacting portion 310 may form to a contour of coupler 200. In other words, coupler 200 forms or shapes contacting portion 310 of post 300. The forming and shaping of the contacting portion 310 may have certain elastic/plastic properties based on the material of contacting portion 310. Contacting portion 310 deforms, upon assembly of the components of coaxial cable connector 100, or, alternatively contacting portion 310 of post 300 may be preformed, or partially preformed to electrically contactedly fit with coupler 200 as explained in greater detail with reference to FIG. 4A through FIG. 4D, below. In this manner, post 300 is secured within coaxial cable connector 100, and contacting portion 310 establishes an electrically conductive path between body 500 and coupler 200. Further, the electrically conductive path remains established regardless of the tightness of the coaxial cable connector 100 on the terminal due to the elastic/plastic properties of contacting portion 310. This is due to contacting portion 310 maintaining mechanical and electrical contact between components, in this case, post 300 and coupler 200, notwithstanding the size of any interstice between the components of the coaxial cable connector 100. In other words, contacting portion 310 is integral to and maintains the electrically conductive path established between post 300 and coupler 200 even when the coaxial cable connector 100 is loosened and/or partially disconnected from the terminal, provided there is some contact of coupler 200 with equipment port. Although coaxial connector 100 in FIG. 2 is an axial-compression type coaxial connector having a post 300, contacting portion 310 may be integral to and monolithic with any type of coaxial cable connector and any other component of a coaxial cable connector, examples of which will be discussed herein with reference to the embodiments. However, in all such exemplary embodiments, contacting portion 310 provides for electrical continuity from an outer conductor of a coaxial cable received by coaxial cable connector 100 through coaxial cable connector 100 to a terminal, without the need for a separate component. Additionally, the contacting portion 310 provides for electrical continuity regardless of how tight or loose the coupler is to the terminal. In other words, contacting portion 310 provides for electrical continuity from the outer conductor of the coaxial cable to the terminal regardless and/or irrespective of the tightness or adequacy of the coupling of the coaxial cable connector 100 to the terminal. It is only necessary that the coupler 200 be in contact with the terminal.

Figure 3A:
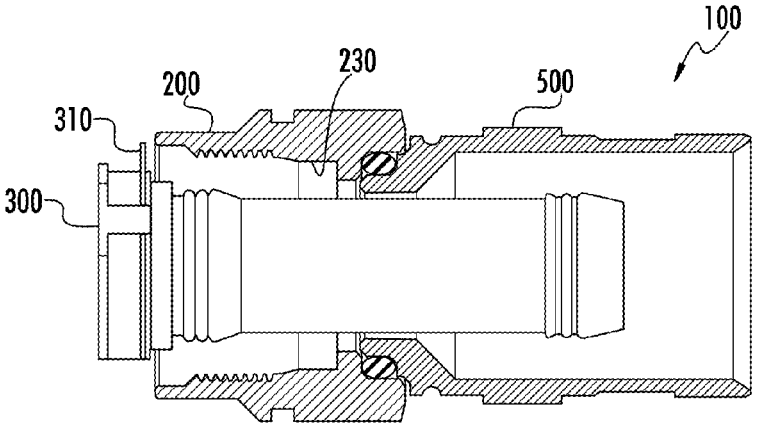
FIG. 3A is side, cross-sectional view of the coaxial cable connector of FIG. 2 in a state of partial assembly.
Figure 3B:
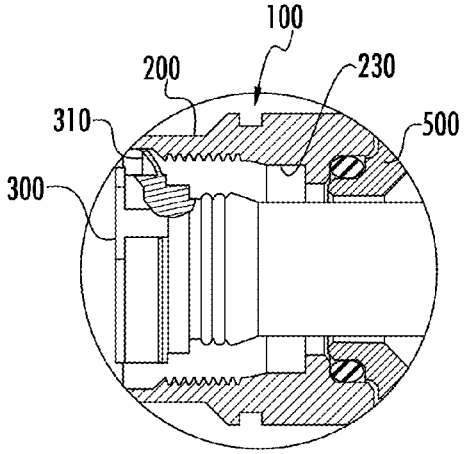
FIG. 3B is a partial, cross-sectional detail view of the post of the coaxial cable connector of FIG. 2 in a state of further assembly than as illustrated in FIG. 3A, and illustrating the contacting portion of the post beginning to form to a contour of the coupler.
Figure 3C:
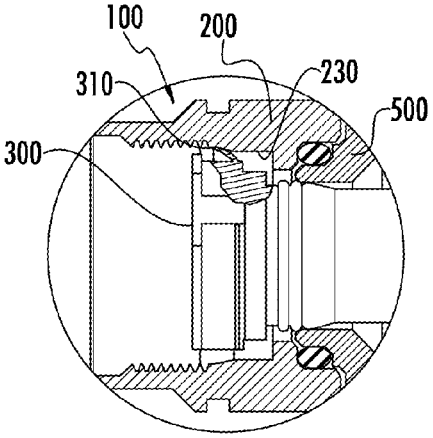
FIG. 3C is a partial, cross-sectional detail view of the post of the coaxial cable connector of FIG. 2 in a state of further assembly than as illustrated in FIGS. 3A and 3B, and illustrating the contacting portion of the post continuing to form to a contour of the coupler.
Figure 3D:
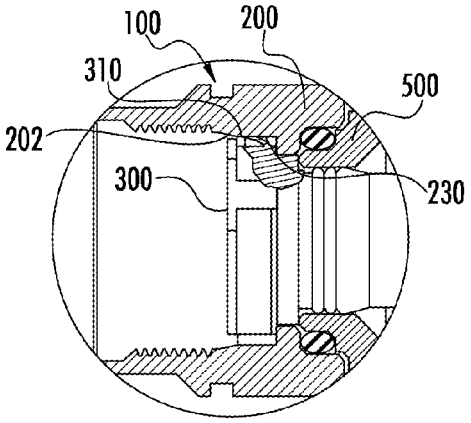
FIG. 3D is a partial, cross-sectional detail view of the post of the coaxial cable connector of FIG. 2 in a state of further assembly than as illustrated in FIGS. 3A, 3B and 3C and illustrating the contacting portion of the post forming to a contour of the coupler.

Referring now to FIGS. 3A, 3B 3C and 3D, post 300 is illustrated in different states of assembly with coupler 200 and body 500. In FIG. 3A, post 300 is illustrated partially assembled with coupler 200 and body 500 with contacting portion 310 of post 300, shown as a protrusion, outside and forward of coupler 200. Contacting portion 310 may, but does not have to be, radially projecting. In FIG. 3B, contacting portion 310 has begun to advance into coupler 200 and contacting portion 310 is beginning to form to a contour of coupler 200. As illustrated in FIG. 3B, contacting portion 310 is forming to an arcuate or, at least, a partially arcuate shape. As post 300 is further advanced into coupler 200 as shown in FIG. 3C, contacting portion 310 continues to form to the contour of coupler 200. When assembled as shown in FIG. 3D, contacting portion 310 is forming to the contour of coupler 200 and is contactedly engaged with bore 230 accommodating tolerance variations with bore 230. In FIG. 3D coupler 200 has a face portion 202 that tapers. The face portion 202 guides the contacting portion 310 to its formed state during assembly in a manner that does not compromise its structural integrity, and, thereby, its elastic/plastic property. Face portion 202 may be or have other structural features, as a non-limiting example, a curved edge, to guide the contacting portion 310. The flexible or resilient nature of the contacting portion 310 in the formed state as described above, permits coupler 200 to be easily rotated and yet maintain a reliable electrically conductive path. It should be understood, that contacting portion 310 is formable and, as such, may exist in an unformed and a formed state based on the elastic/plastic property of the material of contacting portion 310. As the coaxial cable connector 100 assembles contacting portion 310 transition from an unformed state to a formed state.

Figure 4A:
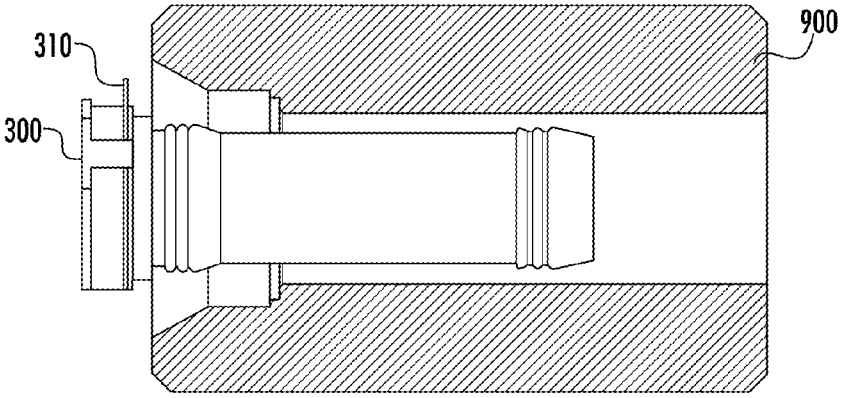
FIG. 4A is a partial, cross-sectional view of the post of the coaxial cable connector of FIG. 2 in which the post is partially inserted into a forming tool.
Figure 4B:
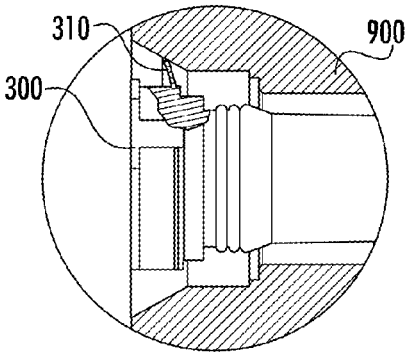
FIG. 4B is a partial, cross-sectional detail view of the post of the coaxial cable connector of FIG. 2 in which the post is inserted into the forming tool further than as illustrated in FIG. 4A using a forming tool and illustrating the contacting portion of the post beginning to form to a contour of the forming tool.
Figure 4C:
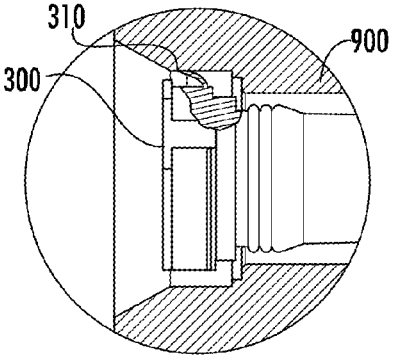
FIG. 4C is a partial cross-sectional detail view of the post of the coaxial cable connector of FIG. 2 in which the post is inserted into the forming tool further than as illustrated in FIGS. 4A and 4B illustrating the contacting portion of the post continuing to form to the contour of the forming tool.
Figure 4D:
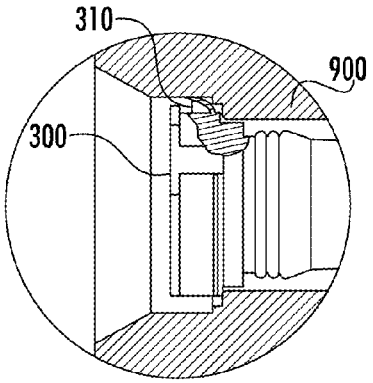
FIG. 4D is a partial cross-sectional detail view of the post of the coaxial cable connector of FIG. 2 in which the post is fully inserted into the forming tool and illustrating the contacting portion of the post forming to the contour of the forming tool.
Figure 5B:
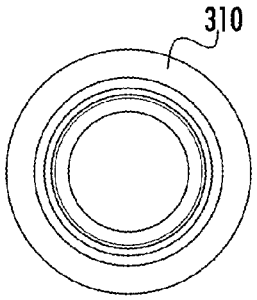
FIGS. 5A through 5H are front and side schematic views of exemplary embodiments of the contacting portions of the post.
Figure 5A:
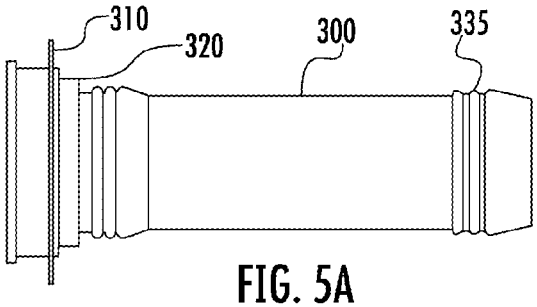
Figure 5D:
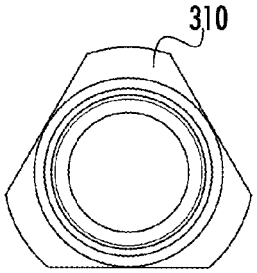
Figure 5C:
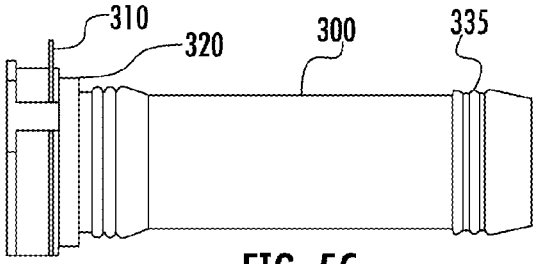
Figure 5F:
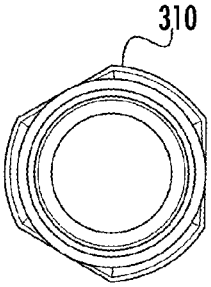
Figure 5E:
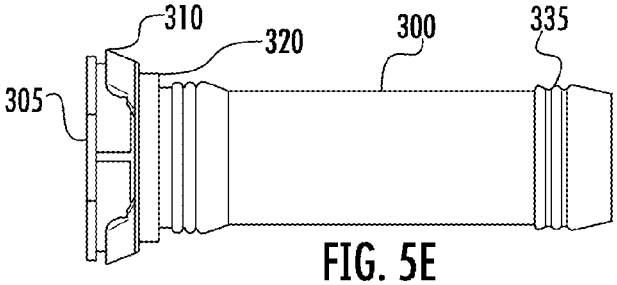
Figure 5H:
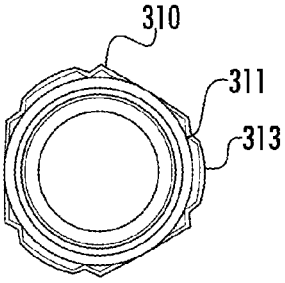
Figure 5G:
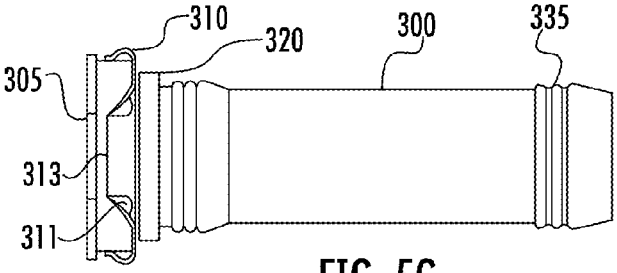

Referring now to FIGS. 4A, 4B, 4C and 4D the post 300 is illustrated in different states of insertion into a forming tool 900. In FIG. 4A, post 300 is illustrated partially inserted in forming tool 900 with contacting portion 310 of post 300 shown as a protrusion. Protrusion may, but does not have to be radially projecting. In FIG. 4B, contacting portion 310 has begun to advance into forming tool 900. As contacting portion 310 is advanced into forming tool 900, contact portion 310 begins flexibly forming to a contour of the interior of forming tool 900. As illustrated in FIG. 4B, contacting portion 310 is forming to an arcuate or, at least, a partially arcuate shape. As post 300 is further advanced into forming tool 900 as shown in FIG. 4C, contacting portion 310 continues forming to the contour of the interior of forming tool 900. At a final stage of insertion as shown in FIG. 4C contacting portion 310 is fully formed to the contour of forming tool 900, and has experienced deformation in the forming process but retains spring or resilient characteristics based on the elastic/plastic property of the material of contacting portion 310. Upon completion or partial completion of the forming of contacting portion 310, post 300 is removed from forming tool 900 and may be subsequently installed in the connector 100 or other types of coaxial cable connectors. This manner of forming or shaping contacting portion 310 to the contour of forming tool 900 may be useful to aid in handling of post 300 in subsequent manufacturing processes, such as plating for example. Additionally, use of this method makes it possible to achieve various configurations of contacting portion 310 formation as illustrated in FIGS. 5A through 5H. FIG. 5A is a side schematic view of an exemplary embodiment of post 300 where contacting portion 310 is a radially projecting protrusion that completely circumscribes post 300. In this view, contacting portion 310 is formable but has not yet been formed to reflect a contour of coaxial cable connector or forming tool. FIG. 5B is a front schematic view of the post 300 of FIG. 5. FIG. 5C is a side schematic view of an exemplary embodiment of post 300 where contacting portion 310 has a multi-cornered configuration. Contacting portion 310 may be a protrusion and may, but does not have to be, radially projecting. Although in FIG. 5C contacting portion 310 is shown as tri-cornered, contacting portion 310 can have any number of corner configurations, as non-limiting examples, two, three, four, or more. In FIG. 5C, contacting portion 310 may be formable but has not yet been formed to reflect a contour of coaxial cable connector or forming tool. FIG. 5D is a front schematic view of post 300 of FIG. 5C. FIG. 5E is a side schematic view of post 300 where contacting portion 310 has a tri-cornered configuration. In this view, contacting portion 310 is shown as being formed to a shape in which contacting portion 310 cants or slants toward the front end 305 of post 300. FIG. 5F is a front schematic view of post 300 of FIG. 5E. FIG. 5G is a side schematic view of an exemplary embodiment of post 300 where contacting portion 310 has a tri-cornered configuration. In this view contacting portion 310 is formed in a manner differing from FIG. 5E in that indentations 311 in contacting portion 310 result in a segmented or reduced arcuate shape 313. FIG. 5H is a front schematic view of post 300 of FIG. 5G.

It will be apparent to those skilled in the art that contacting portion 310 as illustrated in FIGS. 2-5H may be integral to and monolithic with post 300. Additionally, contacting portion 310 may have or be any shape, including shapes that may be flush or aligned with other portions of post 300, or may have any number of configurations, as non-limiting examples, configurations ranging from completely circular to multi-cornered geometries, and still perform its function of providing electrical continuity. Further, contacting portion 310 may be formable and formed to any shape or in any direction.

Figure 6:
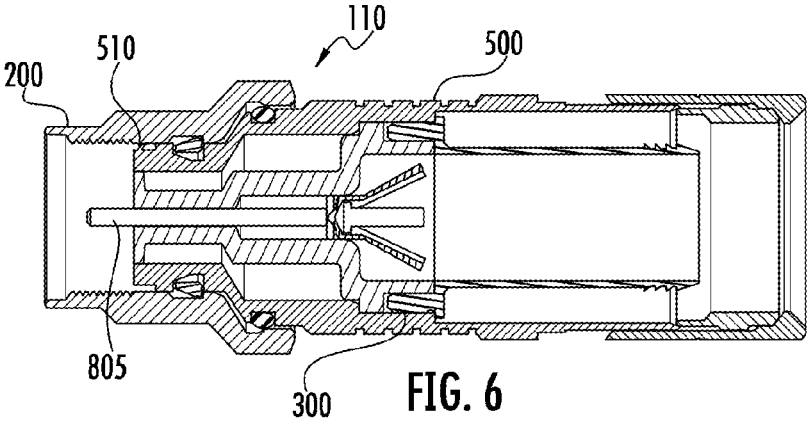
FIG. 6 is a cross-sectional view of an exemplary embodiment of a coaxial cable connector comprising an integral pin, in the state of assembly with body having a contacting portion forming to a contour of the coupler.
Figure 6A:
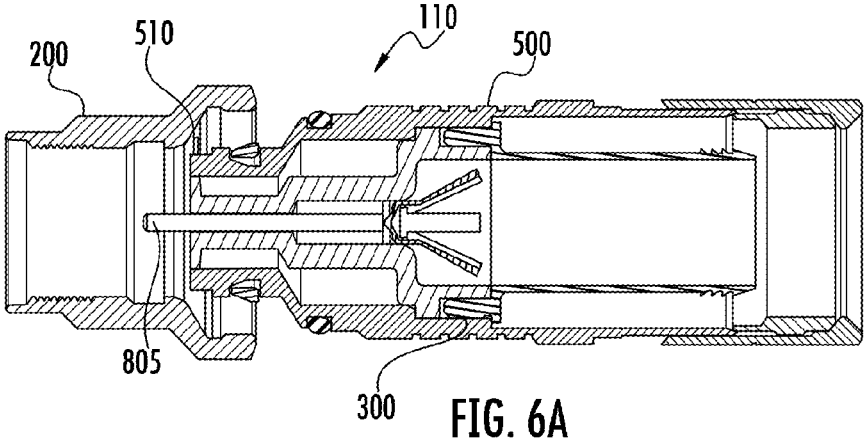
FIG. 6A is a cross-sectional view of the coaxial cable connector illustrated in FIG. 6 in a partial state of assembly illustrating the contacting portion of the body and adapted to form to a contour of the coupler.

FIG. 6 is a cross-sectional view of an exemplary embodiment of a coaxial cable connector 110 comprising an integral pin 805, wherein coupler 200 rotates about body 500 instead of post 300 and contacting portion 510 is a protrusion from, integral to and monolithic with body 500 instead of post 300. In this regard, contacting portion 510 may be a unitized portion of body 500. As such, contacting portion 510 may be constructed with body 500 or a portion of body 500 from a single piece of material. Coaxial cable connector 110 is configured to accept a coaxial cable. Contacting portion 510 may be formed to a contour of coupler 200 as coupler 200 is assembled with body 500 as illustrated in FIG. 6A. FIG. 6A is a cross-sectional view of an exemplary embodiment of a coaxial cable connector 110 in a state of partial assembly. Contacting portion 510 has not been formed to a contour of the coupler 200. Assembling the coupler 200 with the body 500 forms the contacting portion 510 in a rearward facing manner as opposed to a forward facing manner as is illustrated with the contacting portion 310. However, as with contacting portion 310, the material of contacting portion 510 has certain elastic/plastic property which, as contacting portion 510 is formed provides that contacting portion 510 will press against the contour of the coupler 200 and maintain mechanical and electrical contact with coupler 200. Contacting portion 510 provides for electrical continuity from the outer conductor of the coaxial cable to the terminal regardless of the tightness or adequacy of the coupling of the coaxial cable connector 100 to the terminal, and regardless of the tightness of the coaxial cable connector 100 on the terminal in the same way as previously described with respect to contacting portion 310. Additionally or alternatively, contacting portion 310 may be cantilevered or attached at only one end of a segment.

Figure 7:
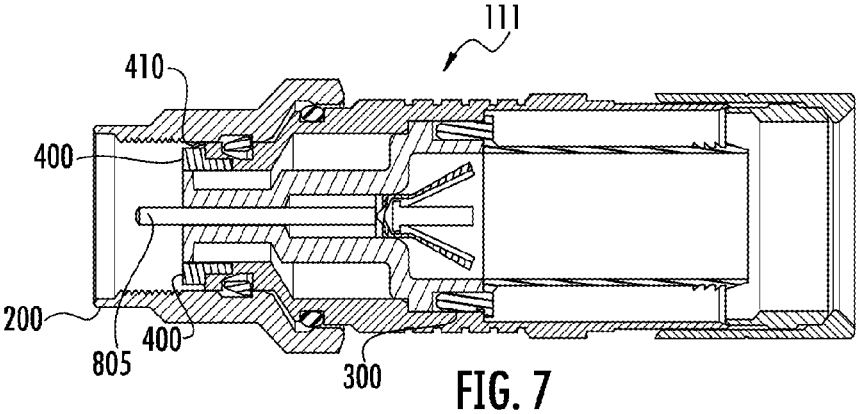
FIG. 7 is a cross-sectional view of an exemplary embodiment of a coaxial cable connector comprising an integral pin, wherein the coupler rotates about a body instead of a post and the contacting portion is part of a component press fit into the body and forming to a contour of the coupler.

FIG. 7 is a cross-sectional view of an exemplary embodiment of a coaxial cable connector 111 comprising an integral pin 805, and a conductive component 400. Coupler 200 rotates about body 500 instead of about a post, which is not present in coaxial cable connector 111. Contacting portion 410 is shown as a protrusion and may be integral to, monolithically with and radially projecting from a conductive component 400 which is press fit into body 500. Contacting portion 410 may be a unitized portion of conductive component 400. As such, the contacting portion 410 may be constructed from a single piece of material with conductive component 400 or a portion of conductive component 400. As with contacting portion 310, the material of contacting portion 410 has certain elastic/plastic property which, as contacting portion 410 is formed provides that contacting portion 410 will press against the contour of the coupler 200 and maintain mechanical and electrical contact with coupler 200 as conductive component 400 inserts in coupler 200 when assembling body 500 with coupler 200 as previously described.

Figure 8:
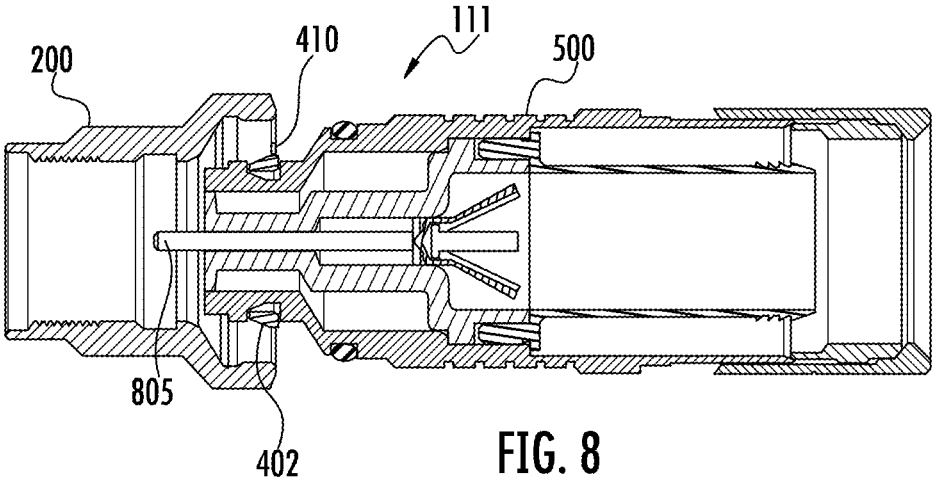
FIG. 8 is a cross-sectional view of an exemplary embodiment of a coaxial cable connector in a partial state of assembly and comprising an integral pin, wherein the coupler rotates about a body instead of a post and the contacting portion is part of a component press position in the body and forming to a contour of the coupler.
Figure 8A:
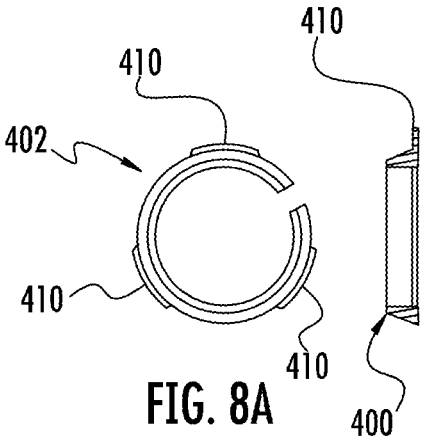
FIG. 8A is a front and side detail view of the component having the contacting portion of the coaxial cable connector of FIG. 8.

FIG. 8 is a cross-sectional view of another exemplary embodiment of the coaxial cable connector 111 comprising an integral pin 805, and a retaining ring 402. The coupler 200 rotates about body 500 instead of a post. Contacting portion 410 may be integral with and radially projecting from a retaining ring 402 which fits into a groove formed in body 500. The contacting portion 410 may be a unitized portion of the retaining ring 402. As such, the contacting portion 410 may be constructed from a single piece of material with the retaining ring 402 or a portion of the retaining ring 402. In this regard, FIG. 8A illustrates front and side views of the retaining ring 402. In FIG. 8A, contacting portion 410 is shown as three protrusions integral with and radially projecting from retaining ring 402. As discussed above, the material of contacting portion 410 has certain elastic/plastic property which, as contacting portion 410 is formed provides that contacting portion 410 will press against the contour of the coupler 200 and maintain mechanical and electrical contact with coupler 200 as retaining ring 402 inserts in coupler 200 when assembling body 500 with coupler 200 as previously described.

It will be apparent to those skilled in the art that the contacting portion 410 as illustrated in FIGS. 6-8A may be integral to the body 500 or may be attached to or be part of another component 400, 402. Additionally, the contacting portion 410 may have or be any shape, including shapes that may be flush or aligned with other portions of the body 500 and/or another component 400, 402, or may have any number of configurations, as non-limiting examples, configurations ranging from completely circular to multi-cornered geometries.

Figure 9:
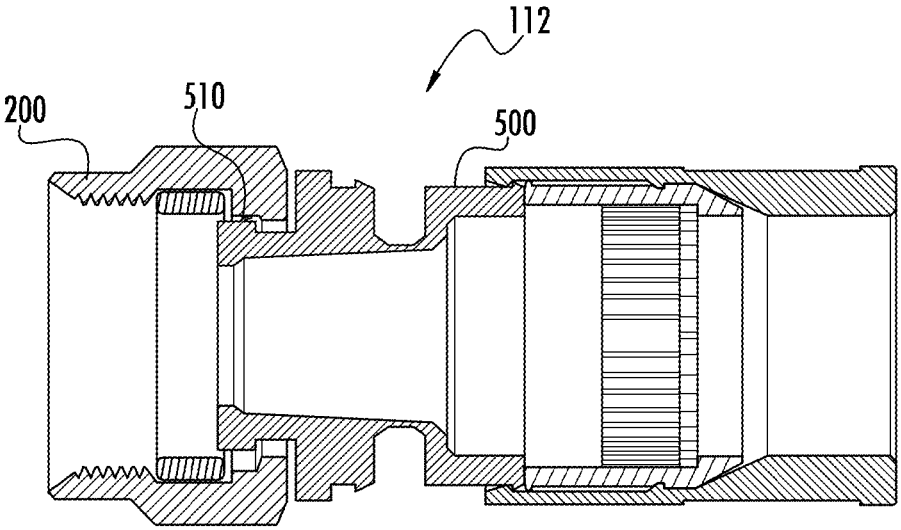
FIG. 9 is a cross sectional view of an exemplary embodiment of a coaxial cable connector comprising a post-less configuration, and a body having a contacting portion forming to a contour of the coupler.

FIG. 9 is a cross-sectional view of an embodiment of a coaxial cable connector 112 that is a compression type of connector with no post. In other words, having a post-less configuration. The coupler 200 rotates about body 500 instead of a post. The body 500 comprises contacting portion 510. The contacting portion 510 is integral with the body 500. As such, the contacting portion 510 may be constructed from a single piece of material with the body 500 or a portion of the body 500. The contacting portion 510 forms to a contour of the coupler 200 when the coupler 200 is assembled with the body 500.

Figure 10:
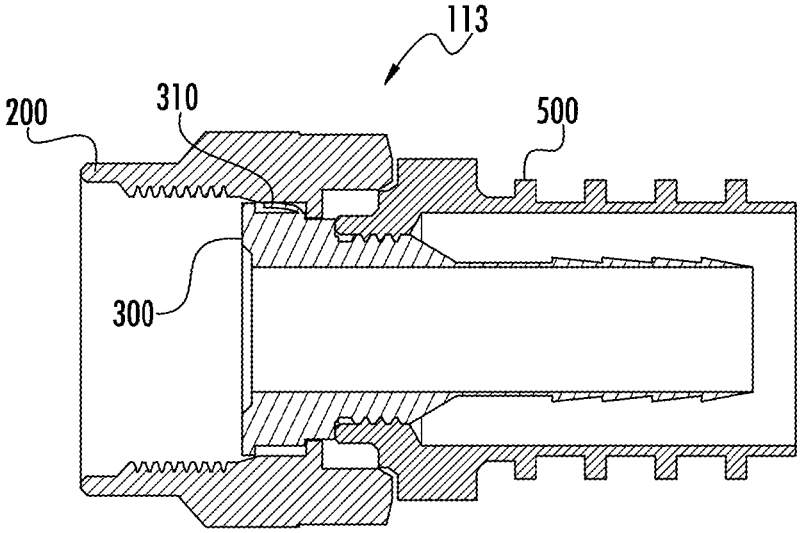
FIG. 10 is a cross sectional view of an exemplary embodiment of a coaxial cable connector comprising a hex crimp body and a post having a contacting portion forming to a contour of the coupler.

FIG. 10 is a cross-sectional view of an embodiment of a coaxial cable connector 113 that is a hex-crimp type connector. The coaxial cable connector 113 comprises a coupler 200, a post 300 with a contacting portion 310 and a body 500. The contacting portion 310 is integral to and monolithic with post 300. Contacting portion 310 may be unitized with post 300. As such, contacting portion 310 may be constructed from a single piece of material with post 300 or a portion of post 300. Contacting portion 310 forms to a contour of coupler 200 when coupler 200 is assembled with body 500 and post 300. The coaxial cable connector 113 attaches to a coaxial cable by means radially compressing body 500 with a tool or tools known in the industry.

Figure 11:
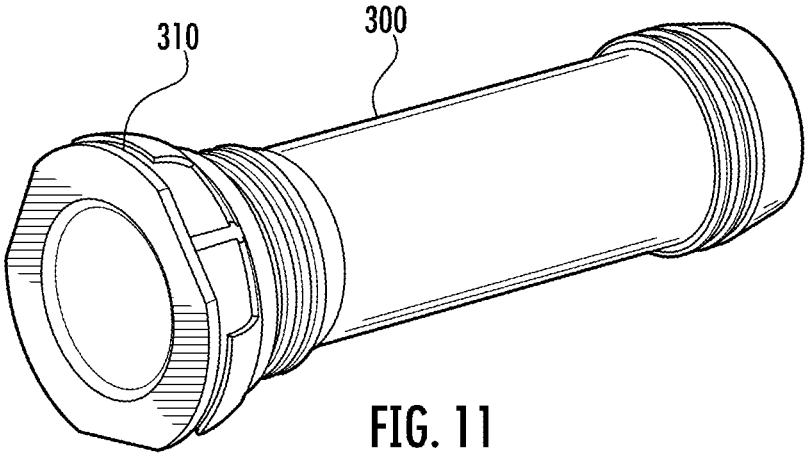
FIG. 11 is an isometric, schematic view of the post of the coaxial cable connector of FIG. 2 wherein the post has a contacting portion in a formed state.

FIG. 11 is an isometric schematic view of post 300 of coaxial cable connector 100 in FIG. 2 with the contacting portion 310 formed to a position of a contour of a coupler (not shown).

Figure 12:
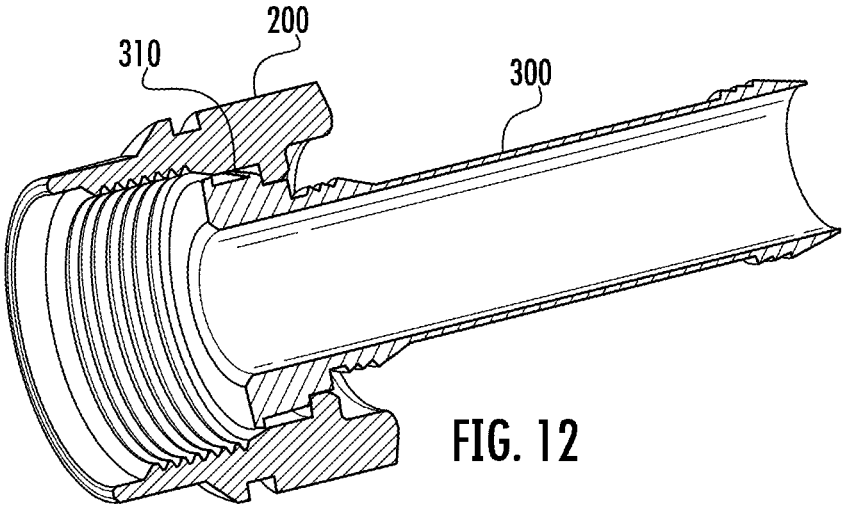
FIG. 12 is an isometric, cross-sectional view of the post and the coupler of the coaxial cable connector of FIG. 2 illustrating the contacting portion of the post forming to a contour of the coupler.

FIG. 12 is an isometric cross sectional view of post 300 and coupler 200 of connector 100 in FIG. 2 illustrated assembled with the post 300. The contacting portion 310 is formed to a contour of the coupler 200.

Figure 13:
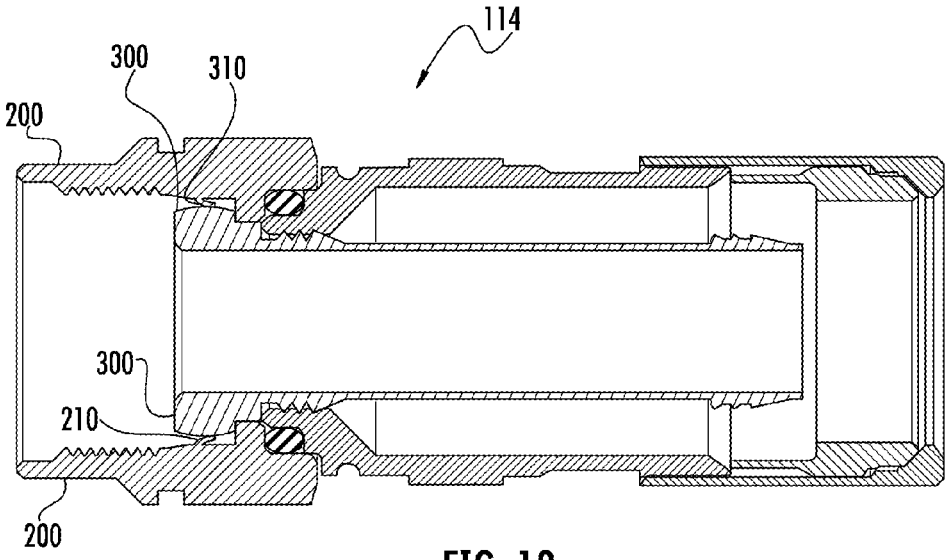
FIG. 13 is a cross-sectional view of an exemplary embodiment of a coaxial cable connector having a coupler with a contacting portion forming to a contour of the post.

FIG. 13 is a cross-sectional view of an embodiment of a coaxial cable connector 114 comprising a post 300 and a coupler 200 having a contacting portion 210. Contacting portion 210 is shown as an inwardly directed protrusion. Contacting portion 210 is integral to and monolithic with coupler 200 and forms to a contour of post 300 when post 300 assembles with coupler 200. Contacting portion 210 may be unitized with coupler 200. As such, contacting portion 210 may be constructed from a single piece of material with coupler 200 or a portion of coupler 200. Contacting portion 210 provides for electrical continuity from the outer conductor of the coaxial cable to the terminal regardless of the tightness or adequacy of the coupling of the coaxial cable connector 114 to the terminal, and regardless of the tightness of coaxial cable connector 114 on the terminal.

Contacting portion 210 may have or be any shape, including shapes that may be flush or aligned with other portions of coupler 200, or may have and/or be formed to any number of configurations, as non-limiting examples, configurations ranging from completely circular to multi-cornered geometries.

Figure 14:
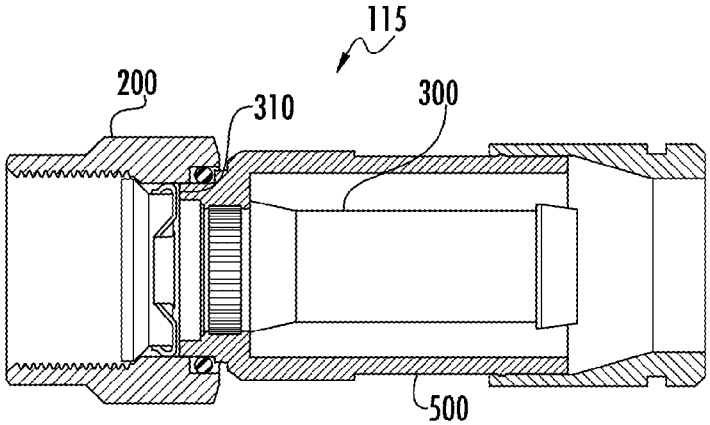
FIG. 14 is a cross-sectional view of an exemplary embodiment of a coaxial cable connector having a post with a contacting portion forming to a contour of the coupler.
Figure 15:
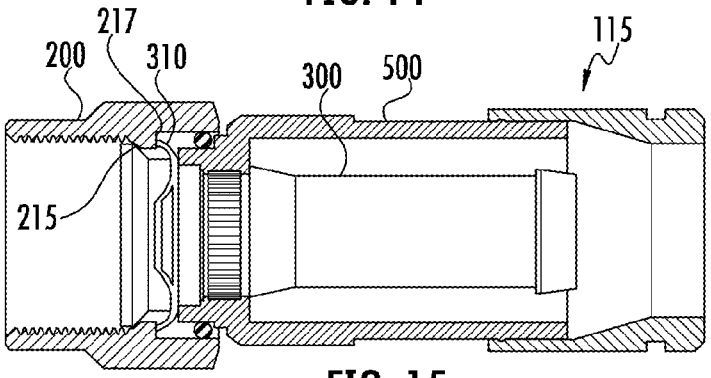
FIG. 15 is a cross-sectional view of an exemplary embodiment of a coaxial cable connector having a post with a contacting portion forming to a contour behind a lip in the coupler toward the rear of the coaxial cable connector.
Figure 16:
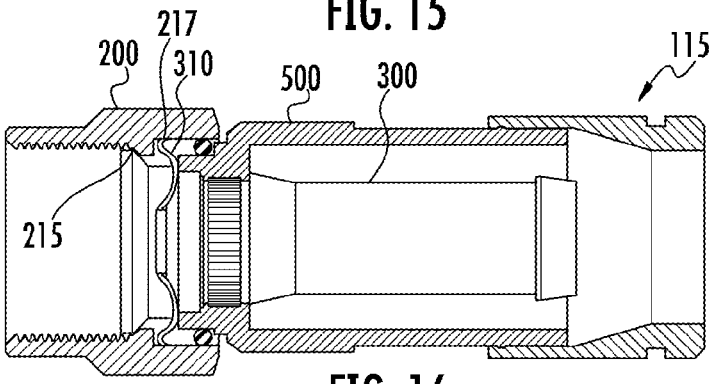
FIG. 16 is a cross-sectional view of an exemplary embodiment of a coaxial cable connector having a post with a contacting portion forming to a contour behind a lip in the coupler toward the rear of the coaxial cable connector.

FIGS. 14, 15 and 16 are cross-sectional views of embodiments of coaxial cable connectors 115 with a post similar to post 300 comprising a contacting portion 310 as described above such that the contacting portion 310 is shown as outwardly radially projecting, which forms to a contour of the coupler 200 at different locations of the coupler 200. Additionally, the contacting portion 310 may contact the coupler 200 rearward of the lip 215, for example as shown in FIGS. 15 and 16, which may be at the rearward facing surface 217 of the lip 215, for example as shown in FIG. 15.

Figure 17:
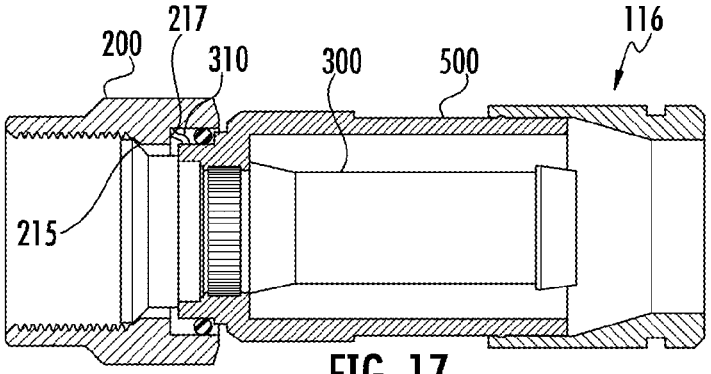
FIG. 17 is a cross-sectional view of an exemplary embodiment of a coaxial cable connector having a body with a contacting portion forming to a contour behind a lip in the coupler toward the rear of the coaxial cable connector.

FIG. 17 is a cross-sectional view of an embodiment of a coaxial cable connector 116 with a body 500 comprising a contacting portion 310, wherein the contacting portion 310 is shown as an outwardly directed protrusion from body 500 that forms to the coupler 200.

Figure 18:
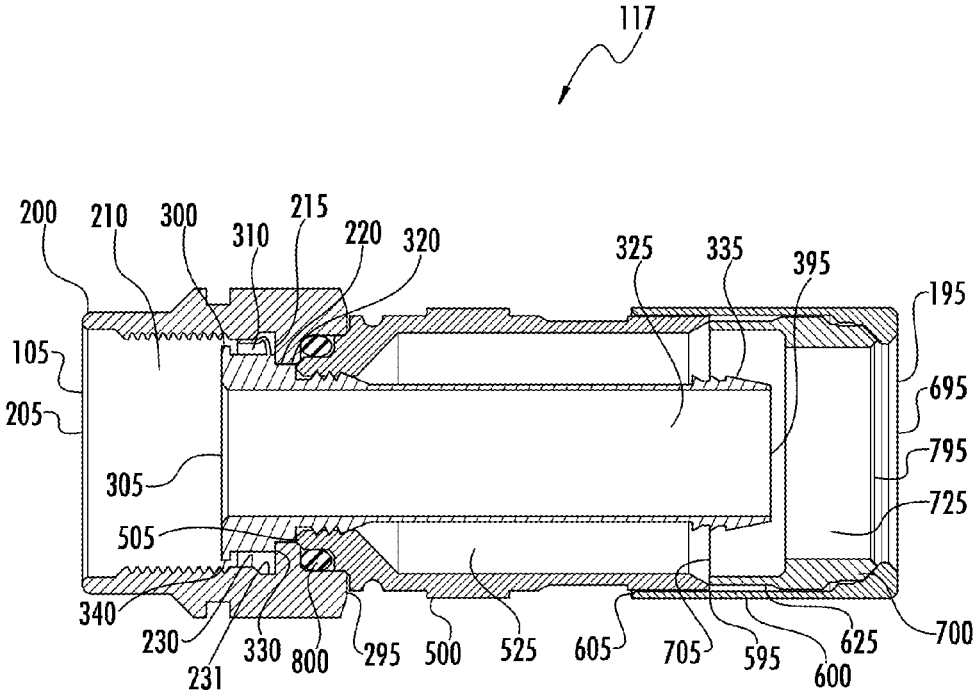
FIG. 18 is a cross-sectional view of an exemplary embodiment of a coaxial cable connector having a post with a contacting portion forming to a contour of a coupler with an undercut.
Figure 18A:
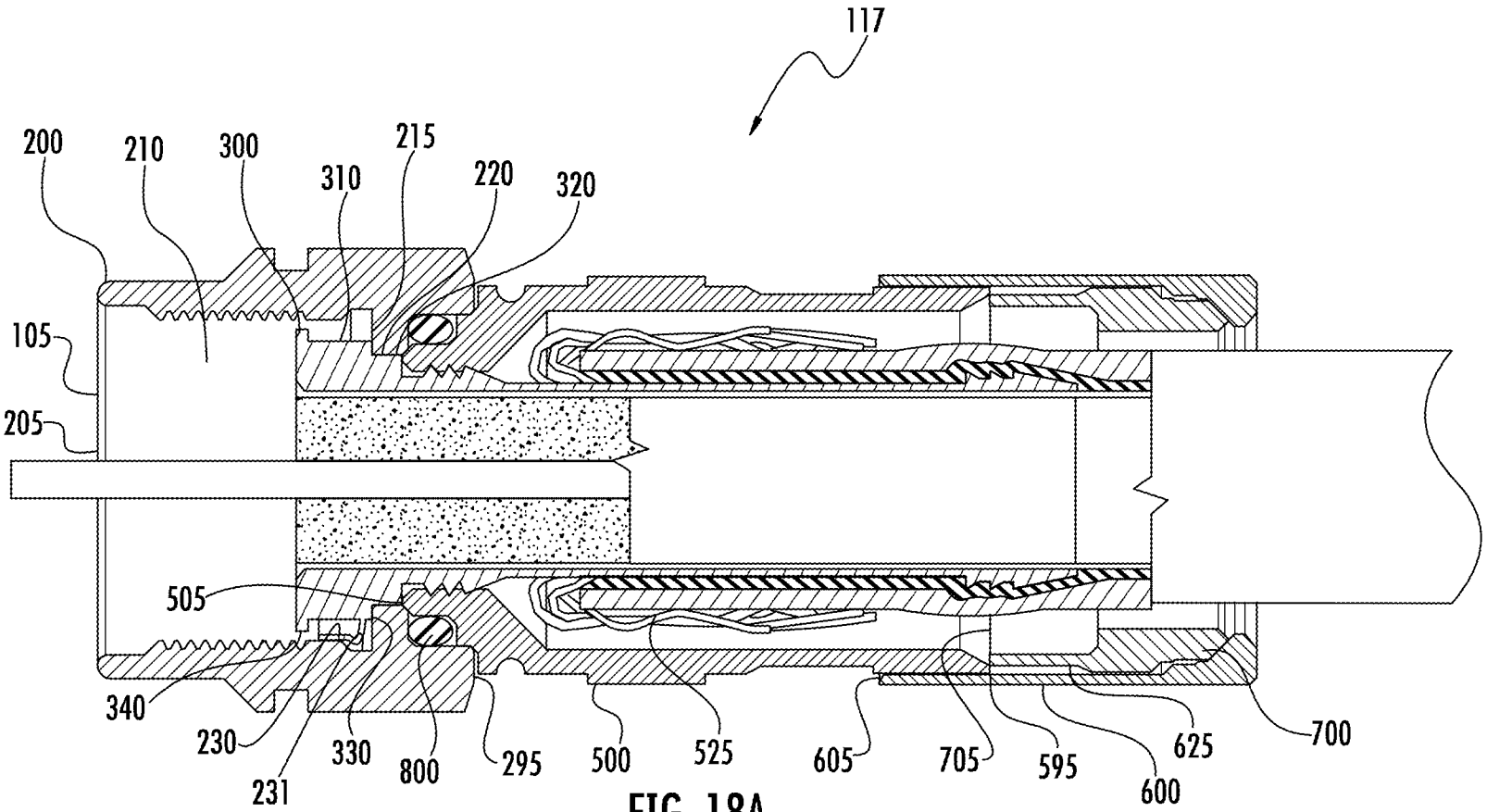
FIG. 18A is a partial, cross-sectional view of an exemplary embodiment of a coaxial cable connector having a post with a contacting portion forming to a contour of a coupler with an undercut having a prepared coaxial cable inserted in the coaxial cable connector.

FIG. 18 is a cross-sectional view of an embodiment of a coaxial cable connector 117 having a post 300 with an integral contacting portion 310 and a coupler 200 with an undercut 231. The contacting portion 310 is shown as a protrusion that forms to the contours of coupler 200 at the position of undercut 231. FIG. 18A is a cross-sectional view of the coaxial cable connector 117 as shown in FIG. 18 having a prepared coaxial cable inserted in the coaxial cable connector 117. The body 500 and the post 300 receive the coaxial cable (FIG. 18A). The post 300 at the back end 395 is inserted between an outer conductor and a dielectric layer of the coaxial cable.

Figure 19:
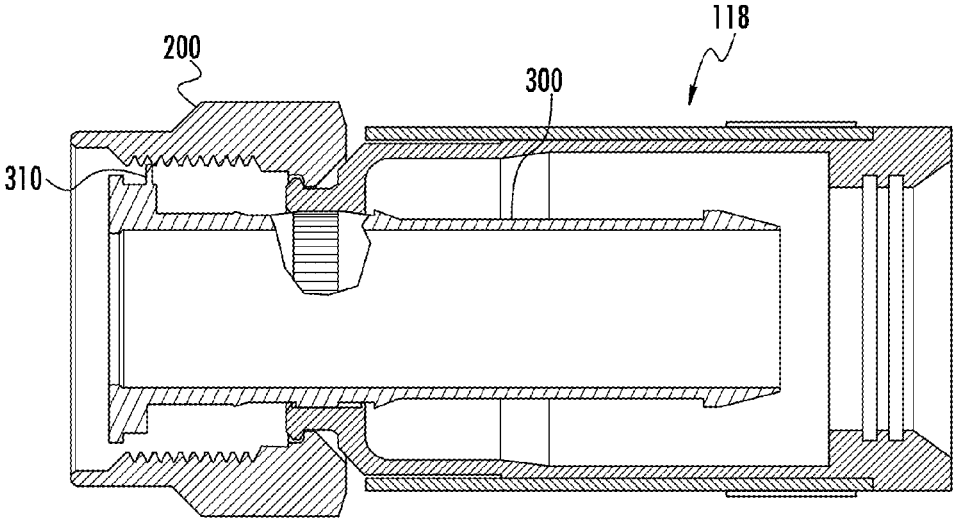
FIG. 19 is a partial, cross-sectional view of an exemplary embodiment of a coaxial cable connector having a moveable post with a contacting portion wherein the post is in a forward position.
Figure 20:
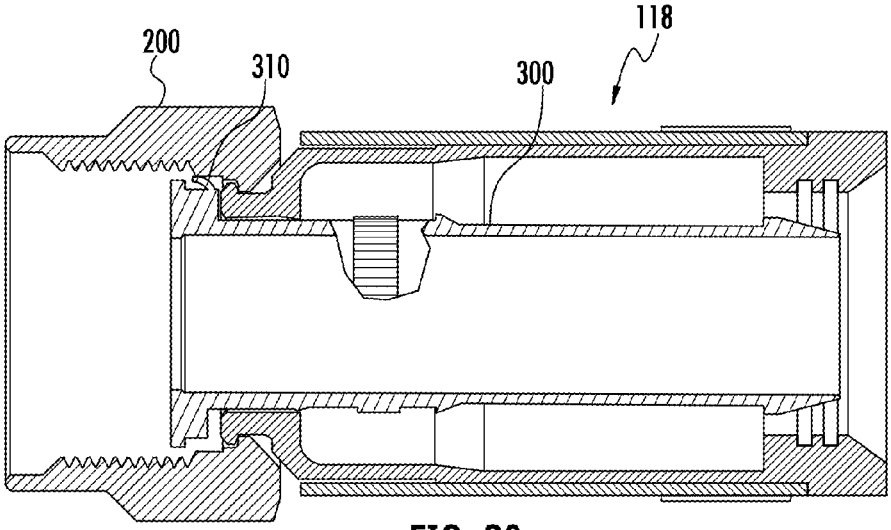
FIG. 20 is a partial cross sectional view of the coaxial cable connector of FIG. 19 with the movable post in a rearward position and the contacting portion of the movable post forming to a contour of the coupler.

FIG. 19 is a partial, cross-sectional view of an embodiment of a coaxial cable connector 118 having a post 301 comprising an integral contacting portion 310. The movable post 301 is shown in a forward position with the contacting portion 310 not formed by a contour of the coupler 200. FIG. 20 is a partial, cross-sectional view of the coaxial cable connector 118 shown in FIG. 19 with the post 301 in a rearward position and the contacting portion 310 forming to a contour of the coupler 200.

It should be understood that while the invention has been described in detail with respect to various exemplary embodiments thereof, it should not be considered limited to such, as numerous modifications are possible without departing from the broad scope of the appended claims. It is intended that the embodiments cover the modifications and variations of the embodiments provided they come within the scope of the appended claims and their equivalents. Although specific terms are employed herein, they are used in a generic and descriptive sense only and not for purposes of limitation.

What is claimed is:

1. A coaxial cable connector for coupling an end of a coaxial cable to a terminal, the coaxial cable comprising an inner conductor, a dielectric surrounding the inner conductor, an outer conductor surrounding the dielectric, and a jacket surrounding the outer conductor, the connector comprising:

a coupler adapted to couple the connector to a terminal, the coupler comprising a lip extending into a central passage defined by the coupler;

a body assembled with the coupler, and a post assembled with the coupler and the body, the post comprising a flange disposed at a front end of the post, wherein the post is adapted to receive an end of a coaxial cable, and wherein at least one of the coupler and the post comprises an integral contacting portion disposed between the flange of the post and the lip of the coupler, the integral contacting portion extending between the coupler and post, and wherein the contacting portion is monolithic with at least a portion of the at least one of the coupler and the post, and wherein when the connector is coupled to the terminal and a coaxial cable is received by the body, the contacting portion provides for electrical continuity from an outer conductor of the coaxial cable through the connector to the terminal regardless of the tightness of the coupling of the connector to the terminal.

2. The connector of claim 1, wherein electrical continuity from an outer conductor of the coaxial cable through the connector to the terminal is provided other than by a separate continuity component.

3. The connector of claim 1, wherein the contacting portion is constructed of a material having an elastic/plastic property allowing it to maintain electrical and mechanical contact notwithstanding any interstice between components of the connector when assembled.

4. The connector of claim 1, wherein the contacting portion is formable.

5. The connector of claim 4, wherein the contacting portion forms to a contour of at least one of the coupler and the post when the post is at least partially assembled with the coupler.

6. The connector of claim 4, wherein the contacting portion forms to a contour of at least one of the body and the post when the post is at least partially assembled with the body.

7. The connector of claim 4, wherein the contacting portion forms to at least a partially arcuate shape.

8. The connector of claim 1, wherein the electrical continuity means a DC contact resistance from the outer conductor of the coaxial cable to the equipment port through the connector of less than about 3000 milliohms.

9. A coaxial cable connector for coupling an end of a coaxial cable to a terminal, the coaxial cable comprising an inner conductor, a dielectric surrounding the inner conductor, an outer conductor surrounding the dielectric, and a jacket surrounding the outer conductor, the connector comprising:

a coupler having a central bore and adapted to couple the connector to a terminal; and a body having a central passage assembled with the coupler, and a post having a front end and a back end, the post assembled with the coupler and the body, wherein the post is disposed at least partially within the central passage of the body and at least partially within the central bore of the coupler, and wherein the body and the post are adapted to receive an end of a coaxial cable, and wherein the post comprises a flange and an integral contacting portion disposed rearward of the flange, the integral contacting portion provides for electrical continuity from an outer conductor of the coaxial cable received by the body and the post through the connector to the terminal coupled by the coupler regardless of the tightness of the coupling of the connector to the terminal, and wherein the contacting portion is constructed from a single piece of material with at least a portion of the post.

10. The connector of claim 9, wherein the contacting portion is constructed of a material having an elastic/plastic property allowing it to maintain electrical and mechanical contact notwithstanding any interstice between components of the connector when assembled.

11. The connector of claim 9, wherein the contacting portion is formable.

12. The connector of claim 11 wherein the contacting portion forms based on a contour of at least one of the body and the coupler when the post at least partially assembles with one of the body and the coupler.

13. The connector of claim 11, wherein the contacting portion forms to at least a partially arcuate shape.

14. The connector of claim 11, wherein the contacting portion forms in response to a forming tool.

15. The connector of claim 9, wherein the contacting portion is a protrusion.

16. The connector of claim 9, wherein the contacting portion is radially projecting.

17. The connector of claim 9, wherein the contacting portion has a multi-cornered configuration.

18. The connector of claim 9, wherein the contacting portion is segmented.

19. A method of providing electrical continuity in a coaxial cable connector, comprising:

providing components of a coaxial cable connector, wherein at least one of the components has an integral, formable contacting portion protruding away from the at least one of the components toward another component, wherein the contacting portion is monolithic with the at least one of the components; and assembling the components to provide a coaxial cable connector, wherein the assembling forms the contacting portion to a contour of the other component, wherein the contacting portion forms in at least a partially arcuate shape.

20. The method of claim 19, wherein the components are composed from the group consisting of a coupler, a body, and a post.

21. The method of claim 19, further comprising:

receiving by one of the components a coaxial cable, and coupling by one of the components the coaxial cable connector to a terminal.

22. The method of claim 19, wherein the contacting portion provides for electrical continuity from an outer conductor of the coaxial cable through the connector to the terminal other than by a separate component and regardless of the adequacy of the coupling of the connector to the terminal.

23. The method of claim 19, wherein is the contacting portion is constructed of a material having an elastic/plastic property allowing it to maintain electrical and mechanical contact notwithstanding any interstice between components when assembled.

24. A coaxial cable connector for coupling an end of a coaxial cable to a terminal, the coaxial cable comprising an inner conductor, a dielectric surrounding the inner conductor, an outer conductor surrounding the dielectric, and a jacket surrounding the outer conductor, the connector, comprising:

a coupler adapted to couple the connector to a terminal; and a body assembled with the coupler, wherein the body is adapted to receive an end of a coaxial cable, and wherein at least one of the coupler and the body comprises an integral contacting portion extending between the coupler and the body, and wherein the contacting portion is monolithic with at least a portion of the at least one of the coupler and the body, and wherein when the connector is coupled to the terminal and a coaxial cable is received by the body, the contacting portion provides for electrical continuity from an outer conductor of the coaxial cable through the connector to the terminal other than by a separate component and regardless of the tightness of the coupling of the connector to the terminal, wherein the contacting portion is formable and the contacting portion forms in at least a partially arcuate shape.

25. The connector of claim 24, wherein the contacting portion is constructed of a material having an elastic/plastic property allowing it to maintain electrical and mechanical contact notwithstanding any interstice between components of the connector when assembled.

26. A coaxial cable connector for coupling an end of a coaxial cable to a terminal, the coaxial cable comprising an inner conductor, a dielectric surrounding the inner conductor, an outer conductor surrounding the dielectric, and a jacket surrounding the outer conductor, the connector, comprising:

a coupler adapted to couple the connector to a terminal; and a body assembled with the coupler, wherein the body is adapted to receive an end of a coaxial cable, and wherein at least one of the coupler and the body comprises an integral contacting portion extending between the coupler and the body, and wherein the contacting portion is monolithic with at least a portion of the at least one of the coupler and the body, and wherein when the connector is coupled to the terminal and a coaxial cable is received by the body, the contacting portion provides for electrical continuity from an outer conductor of the coaxial cable through the connector to the terminal other than by a separate component and regardless of the tightness of the coupling of the connector to the terminal, wherein the contacting portion is formable and the contacting portion forms to a contour of at least one of the body and the coupler when the body at least partially assembles with the coupler.

27. The connector of claim 24, further comprising a post assembled with the coupler and the body.

28. The connector of claim 24, wherein the electrical continuity means a DC contact resistance from the outer conductor of the coaxial cable to the equipment port through the connector of less than about 3000 milliohms.

* * * * *